US005873665A

United States Patent [19]

Aizawa et al.

[11] Patent Number: 5,873,665

[45] Date of Patent: Feb. 23, 1999

[54] PRINTER HAVING A CLAMPING MECHANISM ON THE PLATEN ROLLER

[75] Inventors: Jyun-ichi Aizawa; Kunihiko Nakagawa; Hiroshi Nakao; Hitoshi Ezaki; Kouhei Sunaga, all of Kyoto, Japan

[73] Assignee: Mitsubishi Denki Kabushiki Kaisha, Tokyo, Japan

[21] Appl. No.: 431,750

[22] Filed: May 1, 1995

Related U.S. Application Data

[62] Division of Ser. No. 53,016, Apr. 27, 1993, Pat. No. 5,433,544, which is a continuation of Ser. No. 520,709, May 8, 1990, abandoned.

[30] Foreign Application Priority Data

| | | | |
|---|---|---|---|
| May 8, 1989 | [JP] | Japan | 1-114631 |
| Jun. 15, 1989 | [JP] | Japan | 1-154906 |
| Aug. 21, 1989 | [JP] | Japan | 1-97544 |
| Aug. 21, 1989 | [JP] | Japan | 1-215239 |
| Aug. 21, 1989 | [JP] | Japan | 1-215240 |
| Jan. 29, 1990 | [JP] | Japan | 2-19449 |
| Mar. 2, 1990 | [JP] | Japan | 2-52103 |
| Mar. 2, 1990 | [JP] | Japan | 2-52111 |
| Mar. 16, 1990 | [JP] | Japan | 2-27518 |
| Apr. 6, 1990 | [JP] | Japan | 2-92640 |

[51] Int. Cl.[6] ..... B41J 13/10

[52] U.S. Cl. ..... 400/645; 400/583.3; 400/708; 271/241

[58] Field of Search ..... 400/579, 583.3, 400/596, 645, 645.2, 703, 708, 709, 709.2; 101/246, 409, DIG. 46; 271/228, 241, 277

[56] References Cited

U.S. PATENT DOCUMENTS

| | | | |
|---|---|---|---|
| 3,906,512 | 9/1975 | Farlow | 271/277 |
| 3,918,707 | 11/1975 | Villemer et al. | 271/277 |
| 4,073,489 | 2/1978 | Idstein et al. | 271/277 |
| 4,259,695 | 3/1981 | Nakano | 271/277 |
| 4,358,100 | 11/1982 | Muller | 101/409 |
| 4,390,176 | 6/1983 | Kato | 101/411 |
| 4,552,065 | 11/1985 | Billington et al. | 400/583.3 |
| 4,679,953 | 7/1987 | Sone et al. | 400/625 |
| 4,734,868 | 3/1988 | DeLacy | 400/583 |
| 4,738,555 | 4/1988 | Nagashima | 400/240 |
| 4,839,674 | 6/1989 | Hanagata | 400/579 |
| 4,900,008 | 2/1990 | Ficter et al. | 101/409 |
| 4,909,649 | 3/1990 | Okunomiya | 400/583.4 |

FOREIGN PATENT DOCUMENTS

| | | |
|---|---|---|
| 0180370 | 5/1986 | European Pat. Off. . |
| 0257527 | 3/1988 | European Pat. Off. . |
| 0272802 | 6/1988 | European Pat. Off. . |
| 3816240 | 11/1988 | Germany . |
| 2219281 | 12/1989 | United Kingdom . |

*Primary Examiner*—Stephen R. Funk
*Attorney, Agent, or Firm*—Sughrue, Mion, Zinn, Macpeak & Seas, PLLC

[57] ABSTRACT

A printer for printing characters and images on recording paper comprising: a paper cassette for storing the recording paper; a platen roller around which the recorrding paper is wound at the time of the transfer of images for printing; a clamping mechanism for clamping the recording paper between the clamping mechanism and the platen roller; a motor for driving the platen roller through a gear unit; a thermal printing head for transferring images onto the recording paper; paper feeding rollers for feeding the recording paper from the paper cassette to the clamper; paper discharging rollers for discharging the recording paper upon the completion of the transfer of images thereto; and an ink cassette storing an ink sheet inside thereof; in which the clamping mechanism comprises a clamper which is mounted on the platen roller in such a manner as to permit the free movement of the clamper, holds the recording paper by pushing the recording paper onto the platen roller in a first position and also releases the recording paper in a second position.

4 Claims, 36 Drawing Sheets

PROR ART

PRINTER HAVING A CLAMPING MECHANISM ON THE PLATEN ROLLER

This is a divisional of application Ser. No. 08/053,016 filed Apr. 27, 1993, now U.S. Pat. No. 5,433,544, which is a continuation of Parent application Ser. No. 07/520,709 filed May 8, 1990, now abandoned.

BACKGROUND OF THE INVENTION

1. Field of the Invention

This invention relates to a printer for printing characters and images on recording paper and also to the ink sheet for use on a color thermal printer.

2. Prior Art

FIG. 1 is a perspective view of a conventional printer, in which 1 indicates a paper cassette for storing the recording paper, 2 shows the recording paper stored inside this paper cassette 1, 3 stands for a platen roller around which the recording paper 2 is wound at the time of the transfer of images for printing, 4 represents a clamper free to move in the direction R of the radius of the platen roller 3 mentioned above, 5 indicates a thermal printing head for transferring images onto the recording paper, and 6 marks a motor, the revolutions of which are transmitted from an output gear 7 mounted on the output shaft to a gear 8, then from a gear 9 mounted on the same shaft as this gear 8 to a gear 10 mounted on the rotating shaft 11 of the platen roller 3 mentioned above, and drive the platen roller 3 for its rotation. 12 represents the paper feeding roller which feeds the paper towards the platen roller 3, 13 stands for a paper discharging roller, which discharges the recording paper 2 upon the completion of the transfer of images thereto, 14 denotes an ink sheet stored inside an ink cassette not illustrated in the Figure, and the ink sheet has ink coated on a transparent film. 15 indicates a paper detecting sensor.

Next, the working of the printer is described with reference to FIG. 2 through FIG. 5. FIG. 2 illustrates the state for feeding the paper. The paper feeding roller 12 rotates in the direction as indicated by the arrow mark a in the Figure, thereby transporting the recording paper 2, which passes through the paper detecting sensor 15. In this process, the paper detecting sensor 15 detects the passage of the recording paper 2 and generates the signal as illustrated in FIG. 5. In approximately A seconds after this paper detecting sensor 15 generates the signal, the recording paper 2 is inserted between the clamper 4 and the platen roller 3. The clamper 4 shifts its position to the point $R_1$ in the direction towards the center of the platen roller 3 in the above-mentioned A seconds after this paper detecting sensor 15 generates the signal, and the platen roller 3 holds the recording paper 2, thrusting it under pressure against the platen roller 3. Subsequently, the motor 6 sets into its revolution, and its revolving motion is then transmitted to the platen roller 3 by way of a gear 7, a gear 8, a gear 9, and a gear 10, and, by the rotation of the platen roller 3 in the direction indicated by the arrow mark b, the recording paper 2 is wound around the outer circumference of the platen roller 3.

FIG. 3 illustrates the state of transferring images for their printing. An ink sheet 14 is thrust onto the recording paper 2 by means of the thermal printing head 5, and, while the platen roller 3 rotates in the direction indicated by the arrow mark b1 in the Figure, the thermal printing head 5 generates heat, by which the ink on the ink sheet 14 is sublimated and stuck to the recording paper. By executing this process for sticking the ink in this manner for each of the three colors, i.e. yellow, magenta, and cyan, the printing of images in color is performed on the recording paper 2. The printing of images in each of the colors is started from the moment when the photoelectric switch 16 shown in FIG. 3 detects the clamper 4.

Moreover, when the clamper 4 turns as it passes through the position of the thermal printing head 5, the thermal printing head 5 temporarily escapes upwards so that it will not interfere with the movement of the clamper 4.

FIG. 4 illustrates the state of the discharge of paper. After the color printing of images in three colors is completed, the platen roller 3 turns in reverse in the direction c shown in the Figure, the recording paper 2 being thereby guided to the paper discharging guide not illustrated in the Figure and being then discharged by the paper discharging roller not illustrated in the Figure.

Since the conventional printer is constructed as described hereinabove, it is conceivable, in case there occurs any slip between the paper feeding roller 12 and the recording paper 2, or there occurs any fluctuation in the rotation of the paper feeding roller 12, at the time when the paper is fed, that the recording paper 2 remains in the state not yet inserted between the clamper 4 and the platen roller 3 when the seconds A have elapsed after the paper detecting sensor 15 generates the signal. In this case, the clamper 4 is not able to thrust down the recording paper 2, and it may sometimes happen that the feeding of the paper is not performed in any proper way. In order to prevent such a situation as this, it is necessary to suppress the slipping between the paper feeding roller 12 and the recording paper 2 by suppressing the fluctuations in the rotation of the paper feeding roller 12. In consequence of this, it is required to attain a high degree of precision in the equipment, which in its turn pushes up the costs of the equipment to a high level. Furthermore, even by the use of a high-precision equipment, it is difficult to suppress the slipping between the paper feeding roller 12 and the recording paper 2. Consequently, the positional relation between the clamper 4 and the recording paper 2 while the clamper is holding down the recording paper 2 changes at each such time, with the result the conventional printer is liable to cause the problem that the position of the printed area in relation to the recording paper 2 will fluctuate.

FIG. 6 through FIG. 9 illustrate another conventional printer. In these Figures, 101 represents the recording paper for printing the information, 102 indicates the paper feeding roller for feeding the recording paper 101, 103 stands for the paper discharging roller for discharging the recording paper 101, 104 denotes the paper guide, 105 indicates the platen roller around which the recording paper 101 is wound, 106 marks the clamper which has an oblong hole 161 into which the protrusion 151 provided on the platen roller 105 is fit and which holds the recording paper 101 by thrusting it onto the platen roller 105, 107 expresses the L-shaped member which is joined together with the clamper 106 at the point P and is installed in such a manner as to permit its free rotating motion round the rotating shaft as the center of the motion, 108 represents the pin provided on the other end of the L-shaped member 107, 109 represents the twisting spring suspended between the clamper 106 and the L-shaped member 107 and used for thrusting under pressure the clamper 106 onto the platen roller 105, 111 indicates the thermal printing head for printing images on the recording paper 101, 112 denotes the ink sheet which is formed of a transparent film with ink coated thereon to be stuck to the recording paper 101 through the sublimation of the ink by the heat generated by the thermal printing head 103, 113 marks the ink sheet feeding reel which feeds the ink sheet 112, and 114 designates the take-up reel for winding up the ink sheet 112.

With this conventional printer, the platen roller 105 first turns in the direction indicated by the dotted line, as shown in FIG. 7, and the pin 108 thereby comes into direct contact with the hook 110. By the further rotating motion of the platen roller 105 in the same direction, the L-shaped member 107 moves in rotating motion around the point O as the center of its rotation, thereby lifting up the clamper 106 from the platen roller 5.

Next, the paper feeding roller 106 rotates in the direction along the arrow mark in a solid line, thereby transporting the recording paper 101 and inserting the paper between the clamper 106 and the platen roller 105.

Then, the platen roller 105 moves in its rotating motion in the direction indicated by the arrow mark in a solid line, and the clamper 106 is thereby moved downward, clamping the recording paper 101 and winding the paper as it is round the platen roller 105 as illustrated in FIG. 8.

FIG. 8 represents the modes for the printing of images. The ink sheet is heated, at the same time as it is thrust down under pressure onto the recording paper 101, by the thermal printing head 111. In the meantime, the platen roller 105 rotates in the direction indicated by the arrow mark in a solid line, and thereupon the ink of the ink sheet 112 as sublimated by the thermal printing head 111 is attached to the recording paper 101. With this process being performed three times, i.e. for each of the three colors, yellow, magenta, and cyan, in the regular sequence, images are printed in color. Moreover, the thermal printing head 111 temporarily escapes in the upward direction when the clamper 106 passes the position of the thermal printing head 111, so that the thermal printing head 111 will not get into any direct contact with the clamper 106. Moreover, the hook 110 is so constructed that it escapes into the area on the outside of the rotating orbit of the pin 108, by the action of a driving mechanism not shown in the Figure, so that the hook will not come into any direct contact with the pin 108, when the platen roller 105 moves in its forward rotation, i.e. in the direction shown by the arrow mark in a a solid line.

FIG. 9 illustrates the state of the discharging of paper. After the images are printed in the three colors, the platen roller 105 moves in its reverse rotation in the direction shown by the arrow mark in a dotted line, and the recording paper 101 is thereby guided by the paper guide 104, and the recording paper 101 is discharged with the paper discharging roller 103 rotating in the direction shown by the arrow mark in a solid line. Also, with the reverse rotation of the platen roller 105, the pin 108 comes into its direct contact with the hook 110, and the clamper 106 is thereby lifted upward, releasing the clamp on the recording paper 101, so that the recording paper 101 continues to be transported forward with the paper discharging roller 103 to be discharged out of the printer.

Now that this conventional printer is constructed in such a manner as described above, it is necessary for the printer to turn its platen roller in reverse in order to feed the recording paper or to discharge the paper, with the result that the conventional printer is liable to the problem that the sequence of operations in it is made more complicated and that the printer does not permit any free setting of the paper pass because its paper feeding point and its paper discharging point are identical. This conventional printer is liable also to the problem that it tends to cause a jam of the recording paper while the paper is being transported from the clamper releasing position to the paper discharging paper because the printer performs the discharging of the recording paper by transporting the recording paper to the paper discharging roller while the paper is in the state of being released from the clamper.

FIG. 10 is a configuration chart illustrating a third conventional printer (for example, the printer according to Japanese Patent Application No. 173597-1986).

In this Figure, 201 indicates the recording paper, 202 stands for the clamper, 203 represents a platen roller in a cylindrical shape with an outer circumference somewhat longer than the length of the recording paper 201 mentioned above, and this platen roller takes up around itself the above-mentioned recording paper 201 with its top end secured by the clamper 202 mentioned above. 204 marks the ink sheet, and, on the surface of this ink sheet facing the recording paper 201 mentioned above, sublimatable ink is coated separately in regular sequence for each of the colors, yellow, magenta, and cyan, on its every recording unit area for one screen. 204*a* represents an ink sheet feeding reel around which the ink sheet 204 mentioned above is wound, and this ink sheet feeding reel constantly applies an adequate amount of back tension to the ink sheet 204 mentioned above for the transport of the paper in the direction indicated by the arrow mark. 204*b* denotes an ink sheet take-up reel, which rotates in such a way as to wind the ink sheet round itself. 205 indicates a line-type thermal printing head with heat generating elements 205*a* arranged thereon in a single line in the direction of the width of the recording paper 201 mentioned above. 206 and 107 are guide rollers for guiding the ink sheet 204 mentioned above, and these guide rollers are supported by the same supporting member (not illustrated in the Figure) as the thermal printing head 205 mentioned above. 208 represents a motor, which has a motor shaft 208*a* as its rotating shaft and works as the driving means for rotating the platen roller 203 mentioned above. 209 stands for a gear shaft. 210 represents a driving gear mounted axially on the motor shaft 208*a* mentioned above, and 211 represents a platen gear mounted axially on the platen shaft 203*a* mentioned above. 212 indicates an intermediate gear, which is supported in such a manner as to permit its free rotating motion round the gear shaft 209 mentioned above as the center of its rotation and kept in its constant meshing with the driving gear 210 mentioned above. 213 indicates an intermediate gear, which is supported in such a manner as to permit its free rotating motion round the gear shaft 209 mentioned above as the center of its rotation and kept in its constant meshing with the platen gear 211 mentioned above. The intermediate gears 212 and 213 mentioned above rotate together as one unified set. The modules for all of the driving gear 210 mentioned above, the intermediate gears 212 and 213 mentioned above, and the platen gear 211 mentioned above are identical, and these four gears form the speed reduction, driving, and transmission mechanism. The number of teeth, for example, is 22 on the driving gear 210 mentioned above, 88 on the intermediate gear 212 mentioned above, 59 on the intermediate gear 213 mentioned above, and 118 on the platen gear 211 mentioned above. Here, on the basis of the understanding that the speed reduction ratio means the number of rotations required of the gear at the driving side to make the driven gear rotate by one turn, the speed reduction ratio between the driving gear 210 mentioned above and the intermediate gear 212 mentioned above is 4, and the speed reduction ratio between the intermediate gear 213 mentioned above and the platen gear 211 mentioned above is 2, and the final speed reduction ratio of this speed reduction, driving, and transmission mechanism is 8.

Now, with reference to FIG. 11 through FIG. 13, a description is made of the operations of this third conventional printer, which has a construction described above.

First, the state of the feeding of paper is illustrated in FIG. 11, in which the thermal printing head 205 and the guide rollers 206 and 207 are aloof from the platen roller 203, and, when the clamper 202 is in the position on the platen roller 203 as shown in FIG. 11, the recording paper 201 is transported in the direction indicated by the arrow mark b, and the clamper 202 moves in the direction marked by the arrow mark c, holding the top end of the recording paper 201.

Then, the rotating power of the motor 208 is transmitted to the platen gear 211 by way of the driving gear 210 and the intermediate gears 212 and 213, and, as the result, the platen roller turns in the direction indicated by the arrow mark d, and, when the top end of the recording paper 201 comes to the specified recording start position in the proximity of the thermal printing head 205, the rotation of the motor 208 stops, upon which the rotation of the platen roller 203 comes to a temporary stop. At this moment, the area of the recording paper 201 proper for the starting of the registration of the yellow ink, which is the first color, has come to the position where the ink sheet 204 faces the heat generating element 205*a*. Thereupon, the thermal printing head 205 and the guide rollers 206 and 207 shift their positions in the direction shown by the arrow mark e, and the heat generating element 205*a* is brought into pressure contact with the platen roller 203, with the ink sheet 204 and the recording paper 203 intervening between them. This state is the state for the start of the recording operations and is shown in FIG. 12.

Next, the platen roller 203 rotates in the direction shown by the arrow mark f, and the recording paper 201 and the ink sheet 204, as kept in close contact with each other, are transported in the direction indicated by the arrow mark f, and, at the same time, the signals for the images in yellow are transmitted to the thermal printing head 205 in synchronization with the speed for the transport of the recording paper 201, the heat generating elements 205*a* being thereupon caused selectively to generate heat in regular sequence and to transfer the yellow ink onto the recording paper 201, thereby recording the images in yellow. In the course of this operation, the ink sheet feeding reel 204*a* rotates in the direction shown by the arrow mark h, giving adequate back tension to the ink sheet while the ink sheet take-up reel 204*b* rotates in the direction shown by the arrow mark i, winding the ink sheet 204 around itself. When the recording of the images in yellow is finished by the operations described above, the platen roller 203 comes to a temporary stop of its rotation, and the thermal printing head 205 and the guide rollers 206 and 207 shift in the direction as indicated by the arrow mark j, thereby moving away from the platen roller 203. This state is shown in FIG. 13 as the state of the completion of the recording operation.

Thereafter, the platen roller 203 rotates in the direction shown by the arrow mark k, and, when the top end of the recording paper 201 comes again to the same position as that for the start of the recording of the images in yellow, the platen roller 203 temporarily stops its rotation. In the meantime, the ink sheet 204 is transported by the ink sheet take-up reel 204*b* in the direction indicated by the arrow mark i for a certain prescribed duration of time, and, when the area for the start of the recording of the magenta ink, which is the second color, thus comes to the position facing the heat generating element 205*a*, the ink sheet take-up reel 204*b* stops its rotation.

After all the operations mentioned above with reference to FIG. 13 are completed, the thermal printing head 205 and the guide rollers 206 and 207 move in the direction indicated by the arrow mark m, and the heat generating element 205*a* is brought into pressure contact with the platen roller 203, with the ink sheet 204 and the recording paper 201 intervening between them. Thereupon, the platen roller 203 rotates, with which the images in magenta are recorded in overlapping with the yellow images already recorded on the paper. When the recording of the images in magenta is thus completed, the images in cyan are recorded in the same manner in overlapping with the already finished images, and the recording of the images in color is thereby completed.

In this regard, if there is any lack of uniformity in the pitch or any eccentricity in the pitch circle or the like in at least one gear among the driving gear 210, the intermediate gears 212 and 213, and the platen gear 211, the platen roller 203 will be prone to fluctuations in its rotation even if the motor 208 itself attains a favorable degree of precision in its revolution. Consequently, there occurs a lack of uniformity in pitch on the images as recorded on the recording paper 201. However, the configuration of the gears being such as described above, the intermediate gears 213 and 212 rotate two turns, and the driving gear 210 rotates eight turns, while the platen gear 211 rotates one turn. Therefore, the lack of uniformity in the rotation of the platen roller 203, resulting from such factors as the lack of uniformity in pitch or the eccentricity of pitch circle present in the individual gears, occurs in a cyclical period for each rotation of the platen roller 203. Hence, the relative positions in the relations for the meshing of the individual gears in the course of the recording of the images in yellow, for example, will occur again at the time when the images are recorded in magenta and also at the time when the images are recorded in cyan. As a result, the lack of uniformity in pitch as expressed in the recorded images will be the same for each of the colors, and this achieves a reduction in the deviation of the recorded colors.

In general, the execution of the recording of images in color in high picture quality requires the transfer of a plural number of pigments in duplication onto the same area on the paper, and the precision of this duplication gives considerable influence on the picture quality of the recorded images. If there are any deviations in the relative positions among the images recorded in the individual colors after the transfer of the ink, the so-called color deviation occurs, with the result that the recorded images are accompanied with unnatural color contours and are also affected by a deterioration in the resolution.

However, if an arbitrarily selected speed reduction ratio is set for the individual gears forming the speed reduction, driving, and transmission mechanism, which works to reduce the revolutions of the driving means and to transmit the reduced revolutions to the platen roller, in such a printer as just described, the relations in terms of the relative positions in the meshing of the individual gears at a given point in time in the course of one rotation of the platen roller will be different in some cases from the relative positions in the meshing of the individual gears in the course of the recording of the images in another color. In such a case, the characteristics of the unique irregularity in the revolutions of the individual gears will give different influences for the different colors to the irregularity in the revolutions of the platen roller, and such differences will result in causing deviation of color.

Consequently, it is in practice, as is the case with this type of conventional printer, to employ a method whereby the speed reduction ratios are set in integral numbers for all the individual gears comprising the speed reduction, driving, and transmission mechanism. This makes the relative positions in the relationship of the meshing among the individual gears identical for all the individual colors at any given point in time in the course of one rotation of the platen roller. Thus, the fluctuations which occur in the rotation of the platen roller because of the intrinsic lack of uniformity in the rotation of the individual gears are made identical for all the individual colors, and the deviation of color is thereby reduced.

However, in case the relative positions in the relationship of the meshing among the individual gears are made identical as just described, each of the gears will get into contact with the other individual gears adjacent to it on their teeth in the same parts in every cycle of their rotation, with the result that the teeth in those parts will wear out more readily. In general, this kind of wear does not occur uniformly on all parts of the individual gears, but occur in some parts of the gears, causing a deviation of wear on the individual gears. This phenomenon presents the problem that, not only are fluctuations caused in the rotation of the platen roller, but the service life of the individual gears is shortened very considerably. In view of this problem, it can be pointed out that it is a deviation from the essentially proper designing concept to set in integral numbers all the speed reduction ratios of the individual gears forming the speed reduction, driving, and transmission mechanism.

FIG. 14 is a perspective view illustrating the construction of a fourth conventional printer, and FIG. 15 is a perspective view showing the construction of the paper discharging mechanism. In these Figures, 301 represents a paper cassette for storing the recording paper, 302 indicates the recording paper stored in the inside of this paper cassette, 303 denotes the platen roller around which the recording paper 302 is wound at the time of transferring the images, 304 shows a clamper set for its free movement in the direction R of the radius of the platen roller 303 mentioned above, and 305 marks the thermal printing head which performs the transfer of images onto the recording paper 302. 306 indicates the motor, and the revolutions of this motor are transmitted from the output gear 307, which is installed on the output shaft of the motor, to the gear 308 and then from the gear 310, which is mounted coaxially with this gear 308, to the gear 310, which is mounted on the rotating shaft 311 of the platen roller 303 mentioned above. Thus, the revolutions of the motor so transmitted drive the platen roller 303 for its rotating motion. 312 shows the paper feeding roller which feeds the recording paper 302 mentioned above towards the platen roller 303, and 313 indicates the paper discharging roller which discharges the recording paper 302 on which the transfer of images has been completed. 314 represents an ink sheet, which is stored inside the ink cassette not shown in the Figures but stored inside the ink cassette. Ink sheet 314 is made of transparent film coated with ink. 315 indicates the paper detecting sensor. 316 shows the upper cover for the paper discharging mechanism, and 318 shows a slider which pushes the recording paper 302 to the front face of the printer. 319 represents the optical sensor which detects the recording paper 302 upon its arrival at the prescribed position in the paper discharging mechanism.

Next, the operations are explained with reference to FIG. 16 through FIG. 22. FIG. 16 shows the state of paper feeding. With the paper feeding roller 312 rotating in the direction shown by the arrow mark a, the recording paper 302 is transported forward and passes through the position of the paper detecting sensor 315. Then, the paper detecting sensor 315 detects the passage of the recording paper 302 and generates a signal as shown in FIG. 19. After approximately A seconds after this paper detecting sensor 315 generates the signal, the recording paper 302 is inserted between the clamper 304 and the platen roller 303. The clamper 304 moves in the direction $R_1$ towards the center of the platen roller 303, after the above-mentioned A seconds after the paper detecting sensor 315 generates the signal, and holds the recording paper 302 on the platen roller 303 by applying pressure to the paper. Subsequently, the motor 306 revolves, and its motion is transmitted to the platen roller 303 via the gear 307, the gear 308, the gear 309, and the gear 310, and, with the rotation of the platen roller 303 in the direction shown by the arrow mark b, the recording paper 302 is wound around the outer circumference of the platen roller 303.

FIG. 17 illustrates the state of the transfer of images. The ink sheet 314 is pressed against the recording paper 302 by the thermal printing head 305, and, at the same time as the platen roller 303 rotates in the direction shown by the arrow mark b1 in the Figure, the thermal printing head 305 generates heat, by which the ink on the ink sheet 314 is sublimated and stuck on the recording paper 302. The printer executes the printing of images in color on the recording paper 302 by performing the fixing of the ink in this manner for each of the three colors, yellow, magenta, and cyan. The transfer of images in each of these colors is started at the moment when the photoelectric switch 316 has detected the clamper 304.

Moreover, when the clamper 304 rotates, passing through the position of the thermal printing head 305, the thermal printing head temporarily evacuates upwards lest it should interfere with the movement of the clamper 304.

FIG. 18 shows the state of the discharge of the recording paper. After the completion of the transfer of the images in three colors, the platen roller 303 moves in reverse in the direction shown by the arrow mark c in the Figure, and the recording paper 302 is then guided by the paper discharging guides not shown in the Figure and is transported to the paper discharging mechanism by the paper discharging roller 313. While this operation is being performed, the slider 318 is in its home position as shown in FIG. 20. When the recording paper 302 comes to the prescribed position in the paper discharging mechanism as shown in FIG. 21, the optical sensor 319 detects the recording paper 302. Receiving a signal on the detection of the paper thus generated by the optical sensor 319, the slider 318 shifts its position in the direction A by means of the driving mechanism not shown in the Figure, pushing the paper in the direction A. The recording paper 302 pops out of the front panel not illustrated in the Figure, when the slider 318 has moved to the second position as shown in FIG. 22, and the paper discharging operation is finished thereupon. When the discharging of the paper is thus finished, the slider 318 moves in the direction B, returning to its home position.

The conventional printer is constructed as described above. As static electricity is generated on the recording paper after the transfer of images onto it, the recording paper 302 may sometimes be stuck to the upper cover of the paper discharging mechanism, in which case it is highly probable that a jam of the paper will occur. Furthermore, the conventional printer is prone to the problem that its construction causes considerable difficulty in removing jammed paper from inside its paper discharging mechanism.

FIG. 23 is a perspective view illustrating the construction and operations of the paper discharging mechanism installed in a fifth type of conventional printer.

In this Figure, 401 represents the recording paper, 402 marks the guide, which has a slope 402*a* as illustrated in the Figure. 403*a* and 403*b* are transporting rollers forming a pair and provided in the upper and lower positions respectively, and these rollers are supported in a manner permitting their free rotating motion in the positions shown in the Figure. The transporting roller 403*a* mentioned above is given its force to work on the transporting roller 403*b* mentioned above by a force providing means not shown in the Figure. 404 indicates a motor, which works as the driving means for the transporting roller 403*b* mentioned above, and the pulley 406, which is fixed on the shaft of the motor 404 mentioned above, and 406 is a pulley fixed on the shaft of the above-mentioned transporting roller 403*b*. 407 is a wire, which is the means of transmitting the revolving force of the motor 404 from the pulley 405 mentioned above to the pulley 406 mentioned above. 408 is the upper cover for the above-mentioned guide 402.

Next, a description is made of the paper discharging mechanism in this fifth type of conventional printer constructed as mentioned above.

The revolving power of the motor 404 is transmitted to the transporting roller 403*b* by way of the pulley 405, the wire 407, and the pulley 406, and, as the result of this transmission of the power, the transporting rollers 403*a* and 403*b* rotate respectively in the direction shown by the arrow mark a and the direction shown by the arrow mark b. In this state, the forward end of the recording paper 401 is put between the transporting rollers 403*a* and 403*b*, and the recording paper 401 is transported forward in the direction shown by the arrow mark c, being thereby pushed out onto the slope 402*a*.

When the recording paper 401 is thus pushed out to the full extent by the transporting rollers 403*a* and 403*b*, the recording paper 401 is released from the capture by the above-mentioned transporting rollers 403*a* and 403*b*, so that the paper glides down the slope 402*a* mentioned above to be delivered out of the lower area of the guide 402.

As described so far, the conventional paper discharging mechanism occasionally fails to discharge the paper with certainty since the recording paper sometimes does not slide well over the slope because of a difference in the coefficient of friction between the recording paper and the surface of the slope or since the recording paper sometimes sticks to the slope in consequence of static electricity generated thereon.

Therefore, a discharging mechanism, which operates with a separately provided discharging block, is employed to apply the driving force to discharge the recording paper as pushed out onto the guide by the transporting rollers.

However, even if the discharging block is put into operation only after a certain duration of time has passed after the recording paper is fed into the transporting rollers, without first ascertaining whether or not the recording paper has been fully released from the transporting rollers, the mechanism is liable to make an error in its operation in that the paper discharging block may set into its operation although the recording paper is not yet fully released, on account of various factors, from its engagement in the transporting rollers. Also, a jam of paper may occur as the result of the capture of the fringe of the paper in the guide or the upper cover in consequence of the skew of the recording paper at the time when the paper discharging block is put into its operation.

FIG. 24 and FIG. 26 illustrate one example of the paper transporting method incorporated in a sixth color thermal printer. In these Figures, 501 indicates the recording paper on which information is to be transferred in the form of printed images, 502 marks the clamper which grips and transports the recording paper 501, and 503 represents the platen roller for winding the recording paper 501 around it and for transporting the recording paper 501 and the ink sheet. 504 indicates an ink sheet, which places color on the recording paper 501, and 505 shows the roller for transporting the ink sheet. 506 marks the thermal printing head, which performs the transfer of images to the recording paper 501 by putting the ink sheet 504 against the paper and applying heat to the said ink sheet. 507*a* and 507*b* show the paper feeding rollers, which transport the recording paper 501 from an outside area into the printer mechanism. 508*a* and 508*b* indicate the paper discharging rollers, which transport the recording paper 501 to the outside area.

Moreover, FIG. 30 illustrates the color pattern for one image screen area, and, in this pattern, 510 shows the area for Y (yellow), 511 shows the area for M (magenta), and 513 shows the area for C (cyan). 515*a* and 515*b* represent the detecting part of the sensor.

Next, a description is made of the operations of the equipment.

First, FIG. 24 shows the state of paper feeding. The recording paper 501 is transported by the paper feeding rollers 507*a* and 507*b* to move forward to the clamper 502. At this point, the clamper, which has been open to the outside, closes toward the inner area, clamping the fore end of the recording paper 501. Now, the platen roller 503 begins its rotation in the counterclockwise direction, winding the recording paper 501 around the platen roller 503. When the roller has rotated by approximately three fourths of one rotation, the thermal printing head 506 comes down by rotation and puts the ink sheet 504 into close contact with the recording paper 501 wound around the platen roller 503. Also, heat is applied to the heater line of the thermal printing head, and the ink from the Y (yellow) sheet is first transferred to the recording paper 501 with the rotation of the platen roller 503. When the transfer of images in Y (yellow) is finished, the thermal printing head 506 temporarily shifts its position upward in order that it will not interfere with the passage of the clamper 502, and, when the clamper 502 finishes its passage, the thermal printing head 506 moves down as shown in FIG. 25, and the ink in M (magenta) is transferred this time from the ink sheet 504 to print the images in the same manner as in the transfer of Y (yellow). When the thermal printing head 506 comes down after the passage of the clamper 502 after the completion of the transfer of the images in M (magenta), the clamper operates to form the state of its opening to the outside, as shown in FIG. 27, and, as the images continue to be printed in the final color, C (cyan), with the ink applied from the ink sheet 504, the recording paper 501 arrives at the paper discharging rollers 508*a* and 508*b*, and the recording paper is transported to the outside area by the rotation of the rollers.

As described above, a color print obtained by transferring the three colors, Y, M, and C, in overlapping from the ink sheet 504 onto the recording paper with the rotation of the ink sheet feeding roller 505*a* and the ink sheet take-up roller 505*b* as shown in FIG. 28. In this regard, FIG. 29 and FIG. 28 illustrate the state with the case for the ink sheet removed.

As mentioned above, it is necessary with the ink sheet on this color thermal printer to perform the discharge of the paper by opening the clamper 502 at the time when the images are to be printed in C (cyan) at the final ink transferring process. Thus, the recording paper 501, which has become free at the time of its discharge fails to move forward together with the ink sheet 504 in the course of the transfer of images onto it because of the resistance the paper receives from the guide, etc., and this lag in the movement of the paper works as a factor causing such defects as a deviation of color.

SUMMARY OF THE INVENTION

It is an object of the present invention to provide a printer capable of setting the position of the recording paper at a given proper position in relation to the platen roller by a means available at low cost.

The printer according to the present invention is provided with a photoelectric sensor and a clamper which holds the recording paper by pushing the paper onto the platen roller and is designed to set the clamper into its operation through the detection of the marks printed on the above-mentioned recording paper by means of the photoelectric sensor mentioned above.

In the present invention, the clamper is set into its operation with the signal generated by the photoelectric sensor upon its reading of the marks printed on the recording paper and can thereby hold the recording paper in its proper position by pushing the recording paper onto the platen roller.

It is an object of the present invention to provide a printer which has a simple sequence with only the forward rotation of the platen roller and which permits the free setting of paper pass.

The printer according to the present invention is designed to move the clamper mounted on the platen roller in such a manner as to permit its free movement in two directions by means of a swinging arm, thereby holding the recording paper onto the platen roller and holding the paper in its position on the platen roller or releasing the paper from its hold.

The printer according to the present invention can be moved in two directions by the swinging arm, and, by the effect of this feature, it is possible to construct the platen roller in such a manner as to be rotated only in the fixed direction, which makes it possible to employ a simple operating sequence and to set the paper pass freely.

The printer according to the present invention is designed to hold the recording paper in a first position and to release the paper in a second position with a clamper, which holds the recording paper by pushing it to the platen roller rotating in the fixed direction, in a manner permitting the clamper to move freely.

The printer according to the present invention is designed to have separate positions for the feeding of paper and the discharging of paper, and it is therefore possible freely to set the paper pass on the printer.

The printer according to the present invention is designed to have a construction which permits the guide bush of the clamper to rotate freely in relation to the shaft of the platen roller and which pushes the clamper to the platen roller by means of such force applying means as a spring.

According to the present invention, the platen roller rotates alone as an isolated unit while the clamper in the clamping mechanism remains lifted up from the platen roller, but the clamper and the platen roller rotate together while the clamper is thrust by force applied thereto on the platen roller.

For the present invention, it is an object to offer a printer which attains a reduction in the irregular wear of the individual gears forming the speed reduction, driving, and transmission mechanism, so that the printer can thereby realize a reduction of the fluctuations occurring in the rotation of the platen roller because of the irregular wear of the said gears and can also achieve an extension of the service life of the individual gears.

The printer according to the present invention is a printer provided with a driving means, which rotates the recording paper as wound around a platen roller for the execution of the recording of images in color by transferring a plurality of dyes overlapping in a regular sequence of operations for application of one dye at a time onto the recording paper mentioned above; and a speed reduction, driving, and transmission mechanism, which reduces the number of revolutions of the driving means and transmits the driving power to the platen roller mentioned above, wherein the printer is equipped with a clutch mechanism which is capable of switching between a state in which the speed reduction ratios among the individual gears mentioned above are entirely in integral numbers and another state in which at least one of the speed reduction ratios mentioned above is not an integral number by making changes in the combination of the meshing among the individual gears forming the speed reduction, driving, and transmission mechanism mentioned above.

The printer in the construction described above sets up the state in which all the speed reduction ratios among the individual gears are integral numbers in the course of the registration of images in color at one time and sets up the state in which at least one of the speed reduction ratios among the individual gears is not an integral number only at the time of the paper feeding operation or at the time of the paper discharging operation, thereby effecting a change in the relative positions in the relations of meshing among the individual gears.

For the present invention, it is an object to offer a printer which has a simple sequence of operations with the platen roller moving only in the forward direction and is capable of performing the discharge of the recording paper with certainty without causing any jam at the time of the paper discharging operation.

The printer according to the present invention is provided with a clamper in such a manner as to permit its free movement on the platen roller around which the recording paper is wound, the clamper holding the recording paper by pushing it under pressure onto the platen roller with this clamper, and also provided with a paper guide in the proximity of the clamper and with a thermal printing head, which is positioned so as to face the platen roller and transfers characters and picture images onto the recording paper, so that the recording paper is guided at the time of the paper discharging operation by the thermal printing head, the clamper in the state in which the hold of the recording paper is released, and the paper guide.

The discharging of the recording paper according to the present invention is so designed that the recording paper is guided by the clamper as lifted up, the paper guide, and the thermal printing head. The mechanism embodying this invention attains its enhanced reliability for its performance at the time of its paper discharging operations.

For the present invention, it is an object to offer a printer which is capable of preventing the sticking of the recording paper on the upper cover of its paper discharging mechanism and also easily removing the paper held up in a jam in occurrence inside the paper discharging mechanism.

The printer according to the present invention is provided with an opening in the upper cover for the paper discharging mechanism.

The printer according to the present invention prevents the recording paper from sticking by the effect of static electricity to the upper cover of the paper discharging mechanism and also permits the easy removal of the paper jammed up inside the paper discharging mechanism with a hand put into the mechanism through the opening since an opening is provided in the upper cover for the paper discharging mechanism.

For the present invention, it is an object to offer a printer which is capable of performing the discharge of the recording paper with certainty through the prevention of such troubles as the jamming of paper by transporting the recording paper with the correction of the skew of the recording paper when the recording paper is pushed forward onto the guide by means of the transporting roller, performing the discharge of the recording paper after the paper is released completely from its capture by the transporting roller after the transport of the recording paper by the transporting roller is finished completely, and discharging the recording paper with the correction of the skew of the paper also at the time when the recording paper is discharged by the paper discharging block.

The printer according to the present invention is a printer provided with transporting rollers for transporting the recording paper, a paper discharging block, which discharges the above-mentioned recording paper as transported thereto by the transporting rollers, and transporting rollers mentioned above and a driving means for the paper discharging block mentioned above, wherein the printer is provided with a photoelectric switch, a control circuit for controlling the operation of the driving means mentioned above, and a plural number of paper clamping members for the recording paper mentioned above.

In the printer constructed as described above, the discharge of the recording paper is performed by putting the paper discharging block into operation after the recording paper is released completely from its capture by the transporting rollers after the transport of the recording paper by the transporting rollers is fully completed, and all the operations are performed with the correction of the skew of the recording paper.

The present invention has as an object to offer an ink sheet for use on color thermal printers and capable of producing picture images in color in high quality through prevention of such flaws as deviation of color.

The ink sheet embodying the present invention for its use on color thermal printers is so designed as to be provided with a transparent part without any dye coated thereon after the parts of the said ink sheet respectively coated with ink in Y (yellow), M (magenta), and C (cyan).

According to the present invention, the printer is capable of producing the images in high-quality colors, preventing such flaws as deviation of color because the printer can discharge the recording paper when the printer is in a state other than that for the printing of images since the printer can transport the recording paper forward in the direction of its discharge by putting the platen roller into its rotating motion, without any heat applied to the heater line, using the transparent sheet part of the ink sheet at the time when the recording paper is discharged therefrom and moving down the thermal printing head and bringing the transparent part of the said ink sheet wound around the platen roller into close contact with the recording paper.

BRIEF DESCRIPTION OF THE DRAWINGS

The manner by which the above and other objects, features and advantages of the present invention are attained will be fully evident from the following detailed description when it is considered in light of the drawings, wherein:

FIG. 7 through FIG. 9 are side views of the principal parts of the second printer;

PREFERRED EMBODIMENTS OF THE INVENTION

Reference will now be made in detail to the construction of the first preferred embodiment according to the present invention as illustrated in the accompanying drawings.

It should be understood, however, that the present invention is not limited to these examples of its embodiment, but may be applied effectively to other forms of its embodiment to such an extent as will not deviate from the technical scope defined for the present invention.

Figure 31:
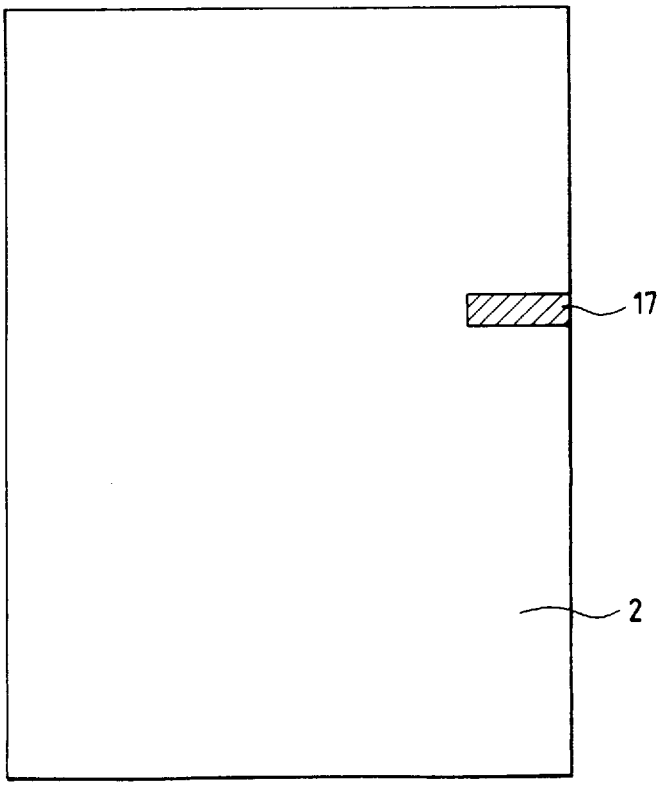
FIG. 31 is a plane view of the recording paper used on the printer according to the first example of preferred embodiment of the present invention.

FIG. 31 is a plane view of the recording paper to be used for the printer according to the present invention. In this Figure, the reference mark represents the mark printed in the prescribed position on the recording paper, and the printer is so designed that the clamper sets into operation when this mark 17 is detected by the paper detecting sensor composed of a photoelectric sensor.

Figure 32:
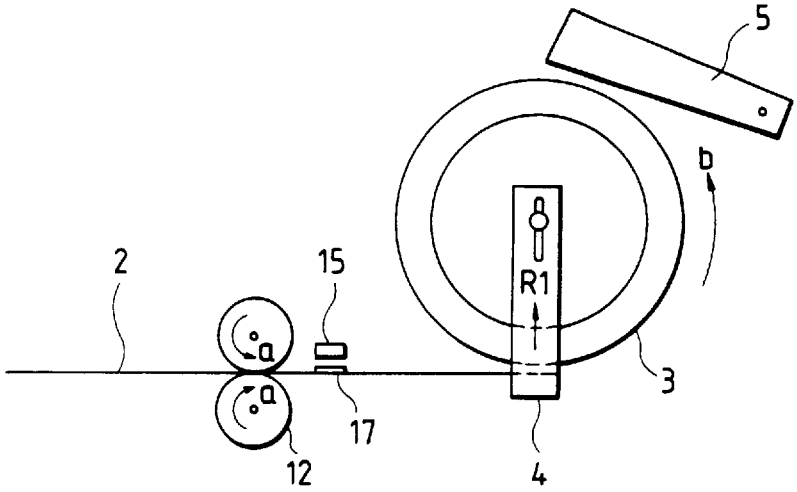
FIG. 32 is a chart illustrating the construction of the printer in respect of a description of the paper feeding operation.

Next, a description is made of the operations to be performed at the time of the discharge of the paper, which forms an essential point of the present invention, with reference to FIG. 32.

Figure 33:
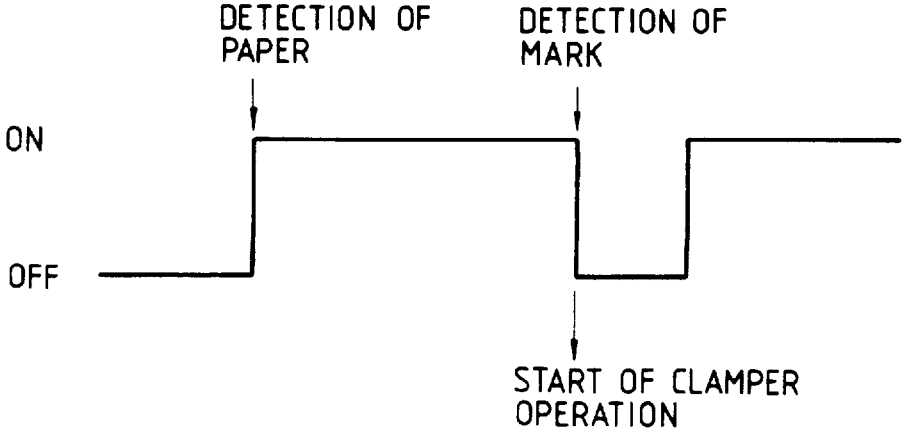
FIG. 33 is a chart illustrating the working of the photoelectric sensor.
Figure 34:
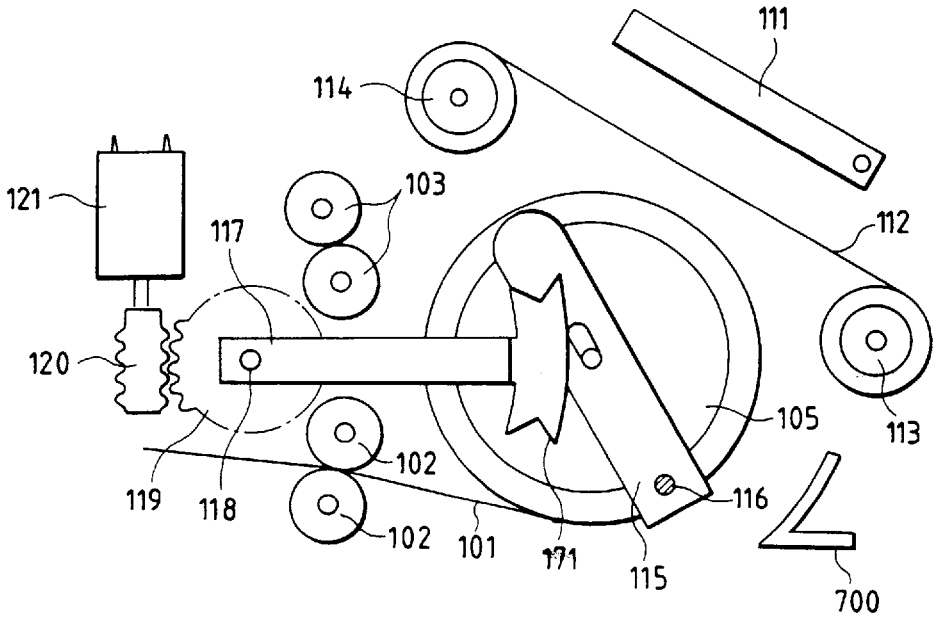
FIG. 34 through FIG. 38 are charts respectively illustrating the second example of preferred embodiment of the present invention, FIG. 34 being a schematic side view, FIG. 35 being a top view, and FIG. 36 through FIG. 38 being side views of the principal parts for use in description of the operations.
Figure 35:
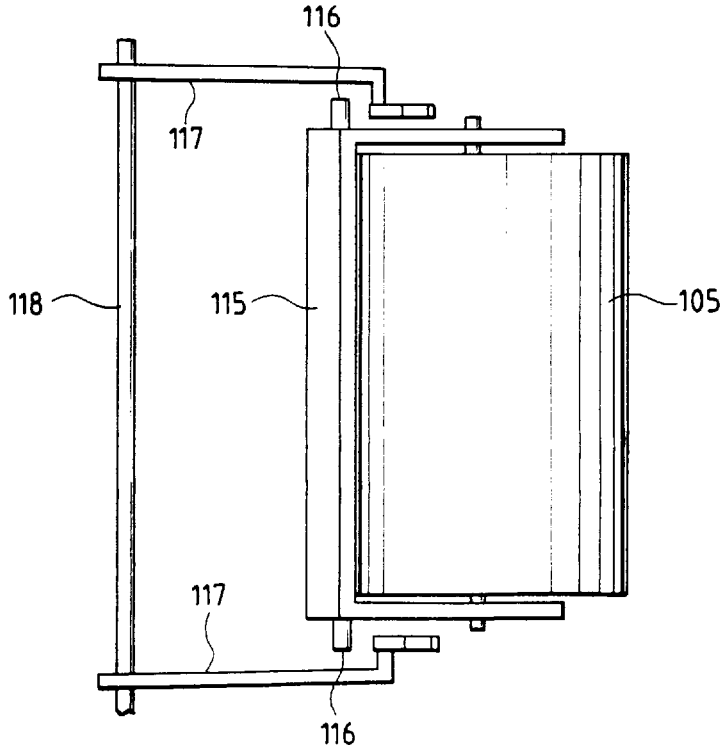

As shown in FIG. 33, the signal generated by the sensor 15 is turned ON when the recording paper 2 is detected by the paper detecting sensor 15 when the recording paper 2 is transported for its feeding with the rotating motion of the paper feeding roller 12 in the direction indicated by the arrow mark a. Thereafter, the recording paper 2 is inserted between the platen roller 3 and the clamper 4, at which moment the mark 17 on the recording paper 2 is detected by the paper detecting sensor 15, and the signal from the paper detecting sensor 15 is thereupon changed from ON to OFF, and, in interlocking with this, the clamper 4 moves in the direction shown by the arrow mark $R_1$ and holds the recording paper 2 by pushing it to the platen roller 3. In this regard, the operations subsequent to this are omitted from the description made at this point since they are the same as those described with respect to the conventional example.

In the example of the preferred embodiment given above, the paper detecting sensor 15 is designed to turn the signal from ON to OFF when the sensor 15 reads the mark 17 on the recording paper 2, but the switchover of the signal may be in the reverse way, i.e. from OFF to ON.

Moreover, the mark 17 on the recording paper is illustrated for a case in which the number of the mark 17 used is one, but the mark 17 may be used in a plural number.

The printer in this embodiment is designed in such a manner that the clamper 4 goes into action, at the same time as the paper detecting sensor 15 has detected the mark 17 placed on the recording paper 2, and pushes the recording paper 2 onto the platen roller 3. Yet, the same effect as that described above can be achieved even if there is an interval of an extremely short period of time, on the order of several tenths of a second.

As described so far, the printer according to the present invention is designed and constructed in such a manner that the clamper holds the recording paper by pushing it onto the platen roller when the photoelectric sensor has detected the mark placed on the recording paper. Therefore, the present invention makes it possible to position the recording paper in a prescribed position in relation to the platen roller with an inexpensive means and thereby makes it possible to set the images in the prescribed position on the recording paper.

In the following part, the second example of the preferred embodiments of the present invention is described with reference to FIG. 34 through FIG. 38.

Specifically, in FIG. 34 through FIG. 38, the reference mark 115 represents the clamper for holding the recording paper 101 onto the platen roller 105 and holding the paper in place, 116 indicates the clamper pin formed in protrusion from the side of the clamper, 117 denotes the swinging arm provided with a V-shaped groove 171 on its top part, 118 indicates the synchronizing shaft for achieving synchronization for the left and right swinging arms, 119 represents the worm wheel for transmitting the motive power to the synchronizing shaft 118, and 120 stands for the worm gear which works in its meshing with the worm wheel 119, being driven with the motor 121 capable of rotating in the forward and reverse directions. In this regard, the turning direction of the swinging arm 117 is changed by the change of the rotating direction of the motor 121.

Also, the swinging arm 117 is so constructed as to get clear of the clamper pin 116 in rotating motion on the way of its motion by a bend formed thereof. 700 indicates the paper guide for guiding the recording paper 101 so as to set it in line with the platen roller 102 mentioned above.

Moreover, the other parts of the construction are omitted from the description made here since they are the same as those of the conventional printer shown in FIGS. 6 through 9.

Figure 36:
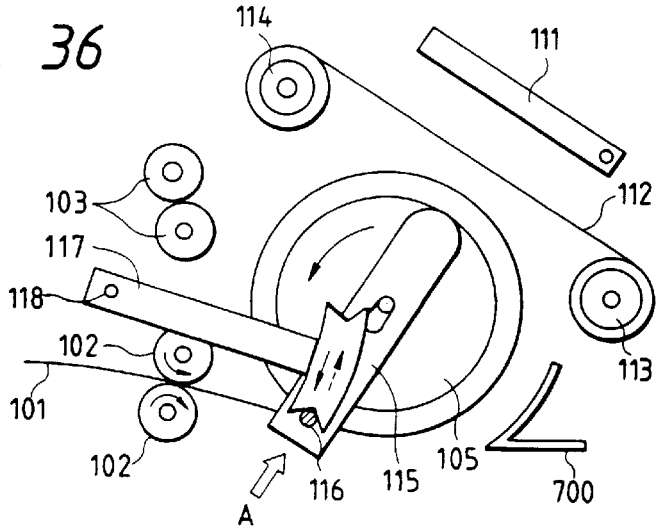

With the mechanism thus constructed, the platen roller 105 first rotates in the direction shown by the arrow mark in a solid line, as illustrated in FIG. 36, and the clamper 115 moves to the first position, point A, which is the point for feeding the paper. Next, the swinging arm 117 is rotated in the direction shown by a solid line with the driving mechanism composed of the motor 121, the worm gear 120, the worm wheel 119, etc. and lifts up the clamper 115 by scooping up the clamper pin 116. Thereupon, the recording paper 101 comes transported by the paper feeding roller 102 and is inserted between the clamper 115 and the platen roller 105, and, with the turning motion of the swinging arm 117 in the direction indicated by the arrow mark in a dotted line, the recording paper 101 is clamped. Then, the platen roller 105 moves in rotation and winds up the recording paper 101.

Figure 37:
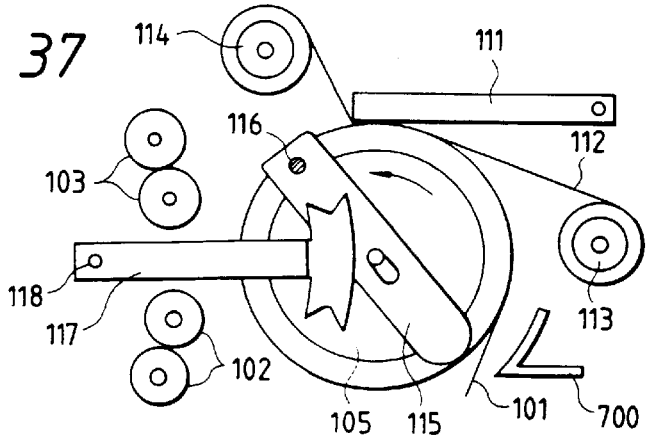

Thereafter, the thermal printing head 111 moves down, as shown in FIG. 37, which illustrates the state of the printing process, and pushes the ink sheet 112 onto the recording paper 101. When electric power is conducted to the thermal printing head 111 while it is in this state, the thermal printing head 111 generates heat, by which the ink on the ink sheet 112 is sublimated and sticks to the recording paper 101. The printing of images in color is executed with this operating process repeated three times, one each for the three colors, yellow, magenta, and cyan, by applying the sublimated ink with the platen roller 105 kept in its rotating motion. Moreover, the thermal printing head 111 escapes temporarily upward when the clamper 115 passes the position of the thermal printing head 111, so that the thermal printing head will not go into its direct contact with the clamper 115. Also, at the time of printing, the swinging arm 117 stands by in the neutral position, so that it will not go into its direct contact with the clamper pin 116 in the course of this process.

Figure 38:
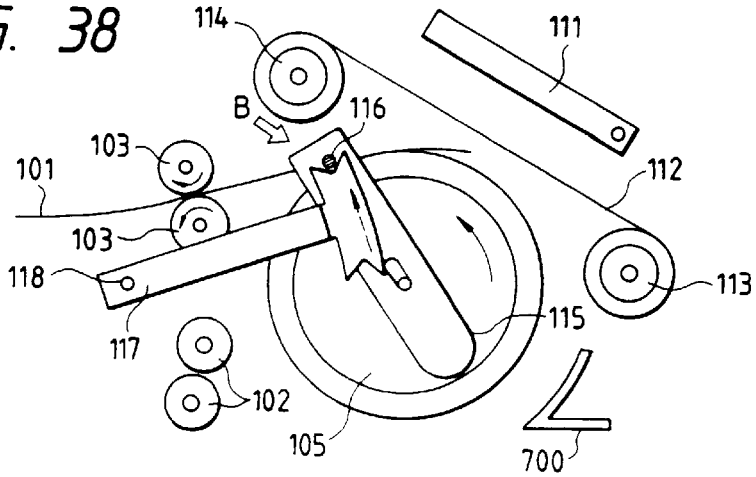
Figure 39:
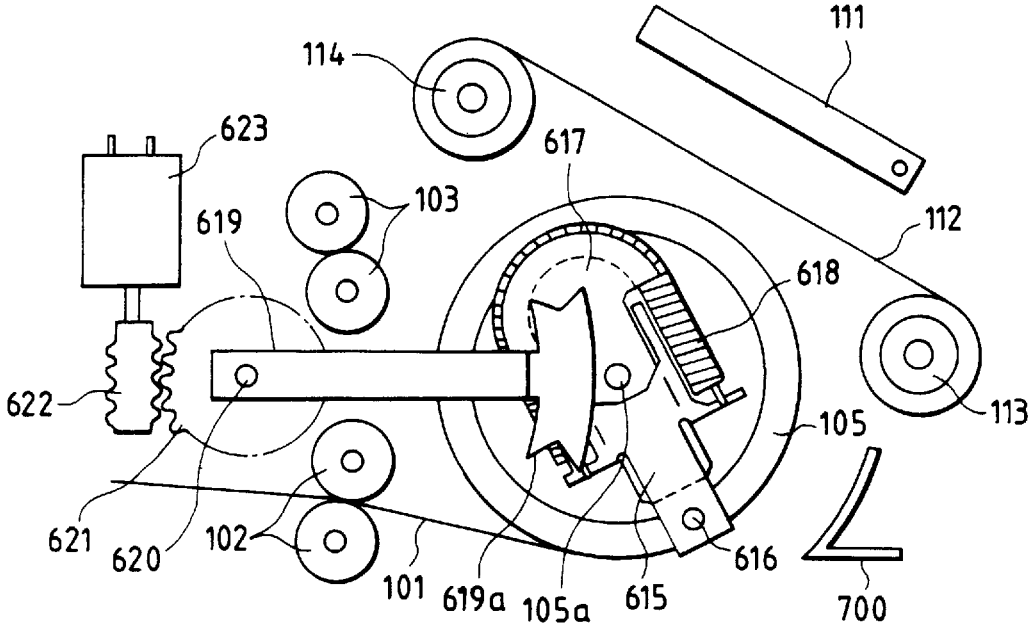
FIG. 39 through FIG. 43 illustrate the third preferred embodiment of the present invention, FIG. 39 being a schematic side view, FIG. 40 being a perspective view of the parts around the platen roller, and FIG. 41 through FIG. 43 being side views of the principal parts for use in description of the operations.
Figure 40:
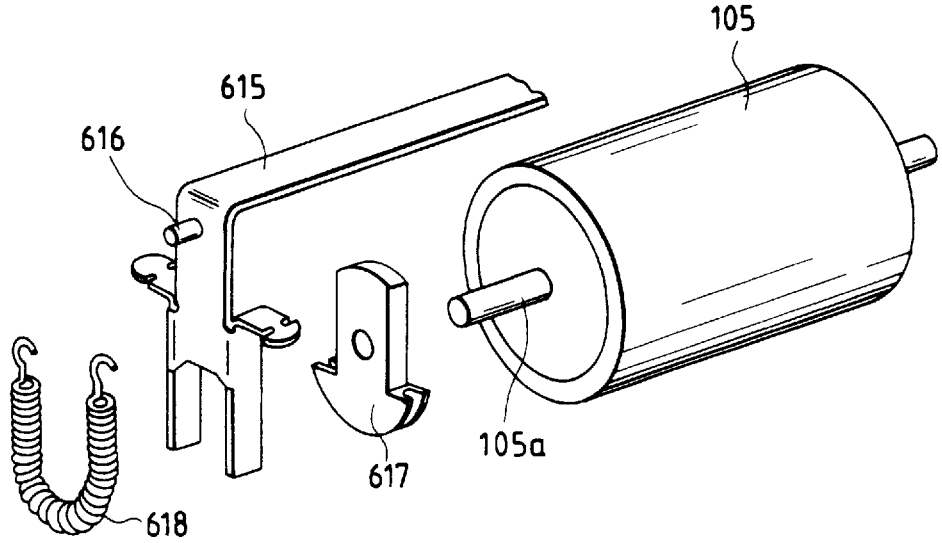

Next, as shown in FIG. 38, which illustrates the state of the discharge of paper, the platen roller 105 rotates in the direction indicated by the arrow mark in a solid line after the completion of the transfer of images, and the clamper 115 moves to the second position, i.e. point B, which is the paper discharging point.

Furthermore, the swinging arm 117 turns in the direction indicated by the arrow mark in a dotted line, being driven by the driving mechanism, and lifts up the clamper 115 by scooping up the clamper pin 116, and the clamp is thereby released, the recording paper 101 being transported to the paper discharging roller 103 by the thrusting pressure of the thermal printing head 111. The paper discharging roller 103 rotates in the direction indicated by the arrow mark in a solid line, and, when the said roller grips the recording paper 101, the thermal printing head 111 moves upward to assume the state shown in FIG. 38, and the recording paper 101 is thereafter discharged solely by the paper discharging roller.

As described so far, the printer according to the present invention is designed to move the clamper in two directions by the action of the swinging arm, and the printer can therefore be constructed so as to move the platen roller in rotation only in the fixed direction, which makes the sequence of operation simple and makes it possible to set the paper pass freely.

Moreover, as described above, the printer according to the present invention is constructed in such a way that the platen roller is rotated only in the fixed direction, the sequence of its operation is thereby made simple, and, since the position for feeding the paper is separate from the position for discharging the paper, it is possible to set the paper pass freely.

In the following part, the third example of the preferred embodiments of the present invention is described with reference to FIG. 39 through FIG. 43. In these Figures, the reference number 615 represents the clamper having a longitudinal bar 615A for holding the recording paper 101 in place by pushing the paper onto the platen roller 105, and the reference number 616 indicates the clamper pin formed in protrusion from the side 615B of the clamper 615. The reference number 617 shows the guide bush joined together with the clamper 615 and also set in a manner permitting its free rotating motion in relation to the shaft 105*a* of the platen roller 105, and the reference number 618 indicates the spring suspended in a U-shape on the clamper 615 by way of the guide bush 617 in order to apply force to the clamper 615 towards the platen roller 105. The reference number 619 indicates a pair of swinging arms provided with a V-shaped groove 619*a* at the top, and the reference number 620 expresses the synchronizing shaft for achieving the synchronization of the left and right swinging arms 619. The reference number 621 denotes a worm wheel for transmitting the motive power to the synchronizing shaft 620. The reference number 622 represents the worm gear driven with a motor 623, which can revolve in the forward and reverse directions.

Also, the swinging arm 619 is constructed to have a bend in its middle part, so that it can avoid the clamper pin 616 in its rotating motion. The reference number 700 indicates the paper guide which guides the recording paper 101 and brings the paper in line with the platen roller 102 mentioned above.

Figure 8:
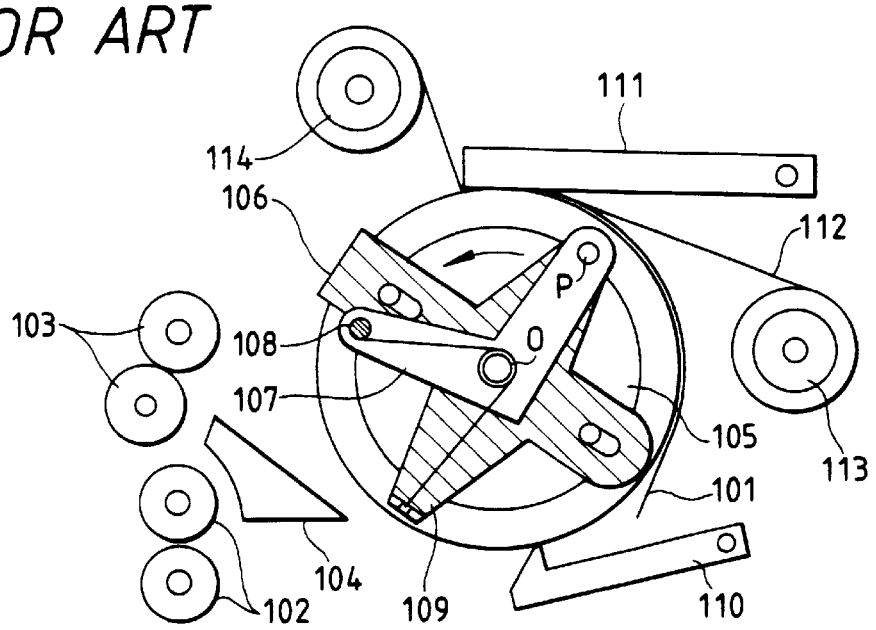
FIG. 8 PRIOR ART
Figure 9:
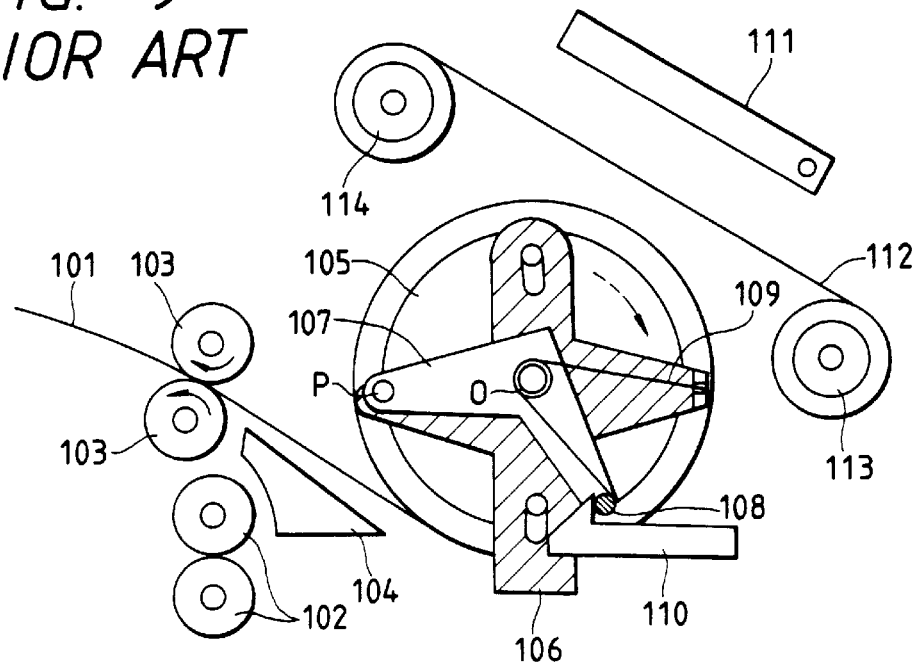
FIG. 9 PRIOR ART
Figure 10:
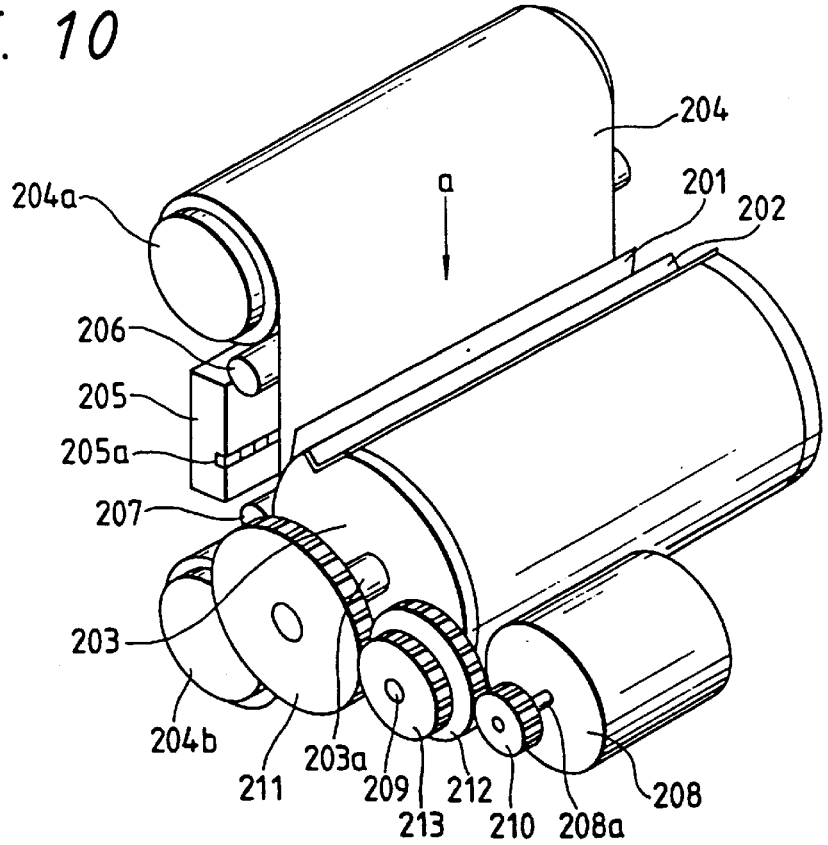
FIG. 10 PRIOR ART
FIG. 10 through FIG. 13 are charts illustrating a third conventional printer, FIG. 10 being a schematic side view and FIG. 11 through FIG. 13 being side views of the principal parts of the printer for use in description of the operations of the printer.
Figure 11:
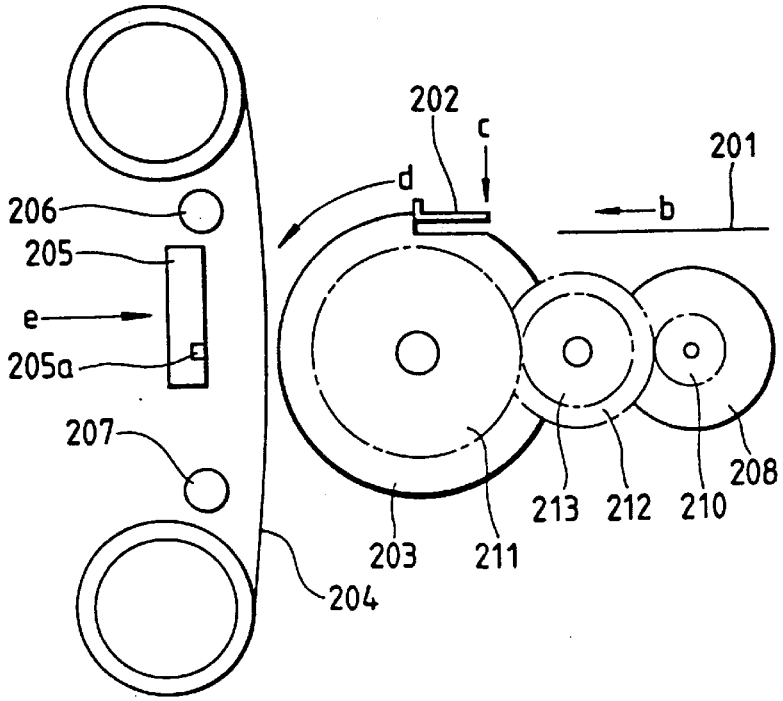
FIG. 11 PRIOR ART
Figure 12:
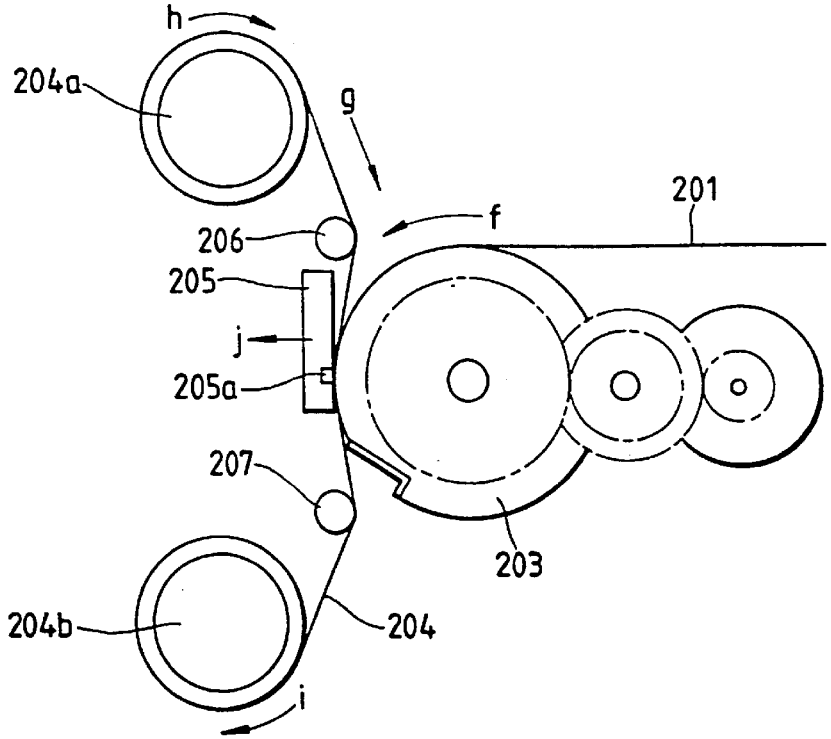
FIG. 12 PRIOR ART
Figure 13:
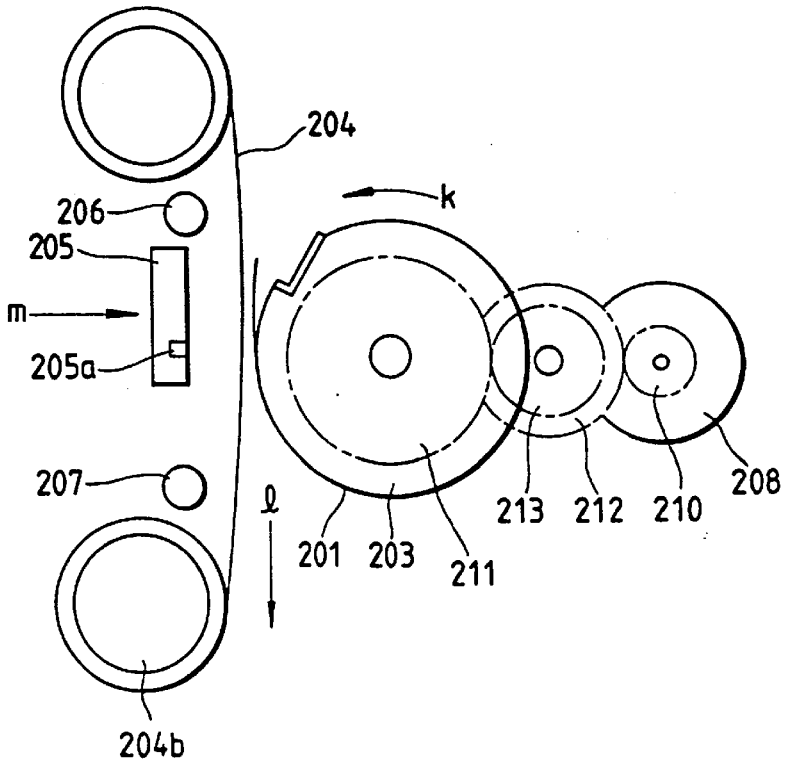
FIG. 13 PRIOR ART
Figure 14:
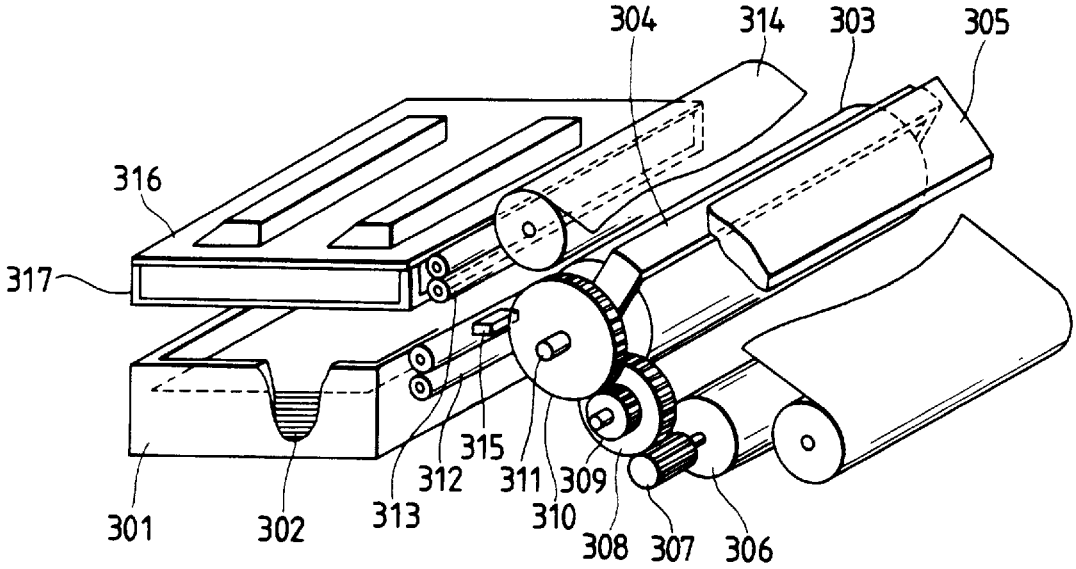
FIG. 14 PRIOR ART
FIG. 14 is a perspective view showing a fourth conventional printer.
Figure 15:
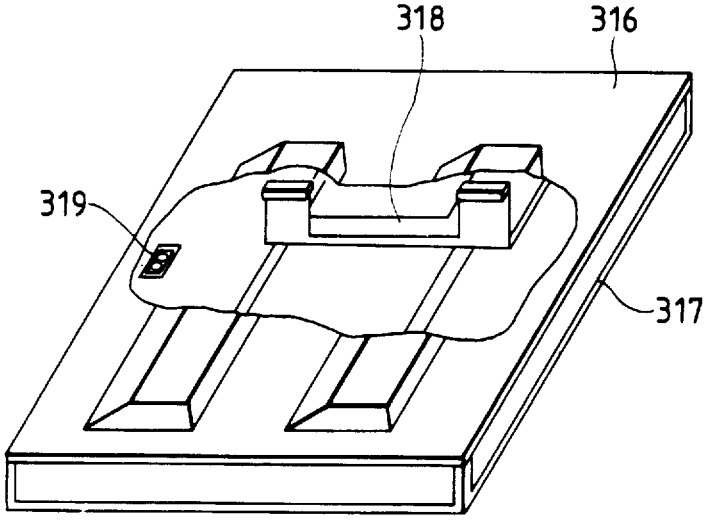
FIG. 15 PRIOR ART
FIG. 15 is a perspective view showing the construction of the paper discharging mechanism of the printer of FIG. 14.
Figure 16:
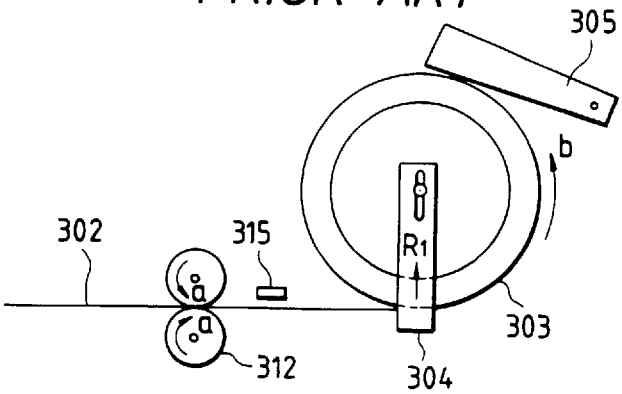
FIG. 16 PRIOR ART
FIG. 16 through FIG. 18 are charts for use in description of the operations of the fourth printer.
Figure 17:
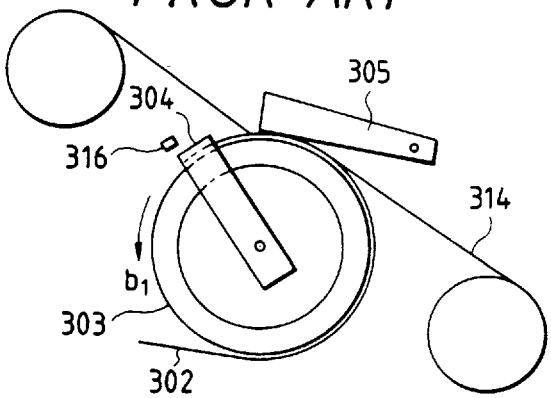
Figure 18:
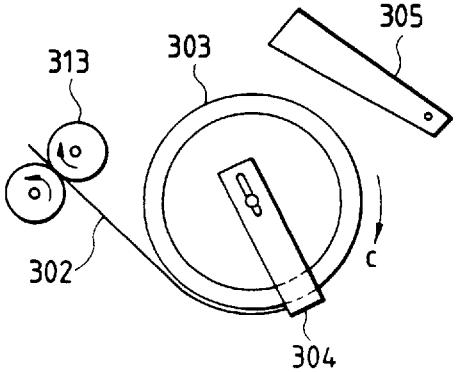
FIG. 18 PRIOR ART
Figure 19:
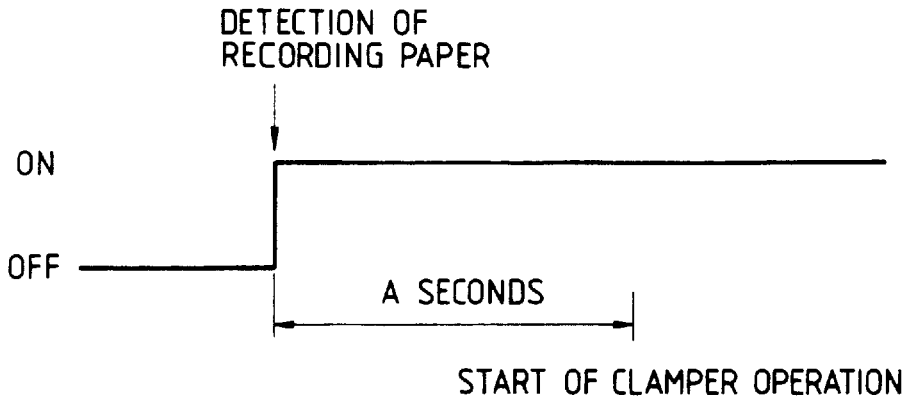
FIG. 19 PRIOR ART
FIG. 19 is a chart illustrating the operating condition of the paper detecting sensor of the fourth conventional printer.
Figure 20:
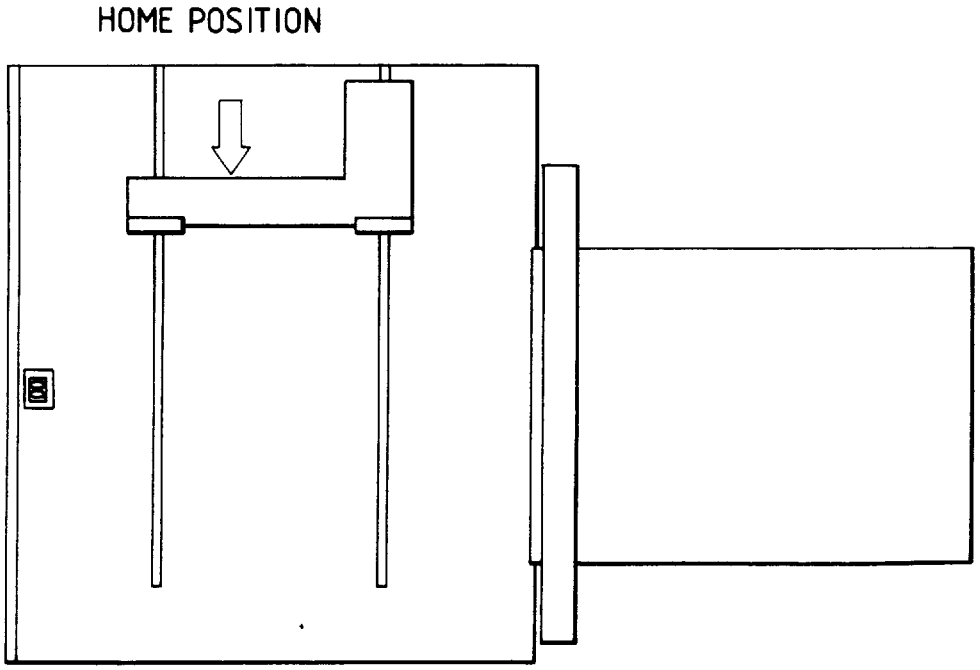
FIG. 20 PRIOR ART
FIG. 20 through FIG. 22 are charts for use in description of the operations of the paper discharging mechanism of the fourth conventional printer.
Figure 21:
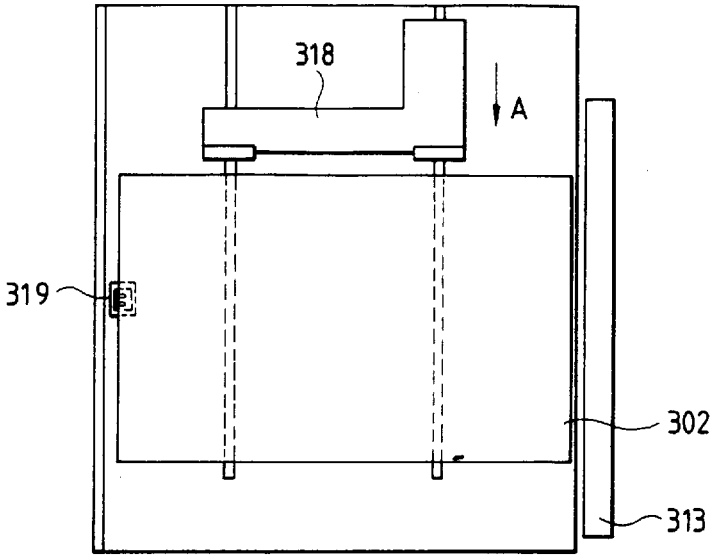
FIG. 21 PRIOR ART
Figure 22:
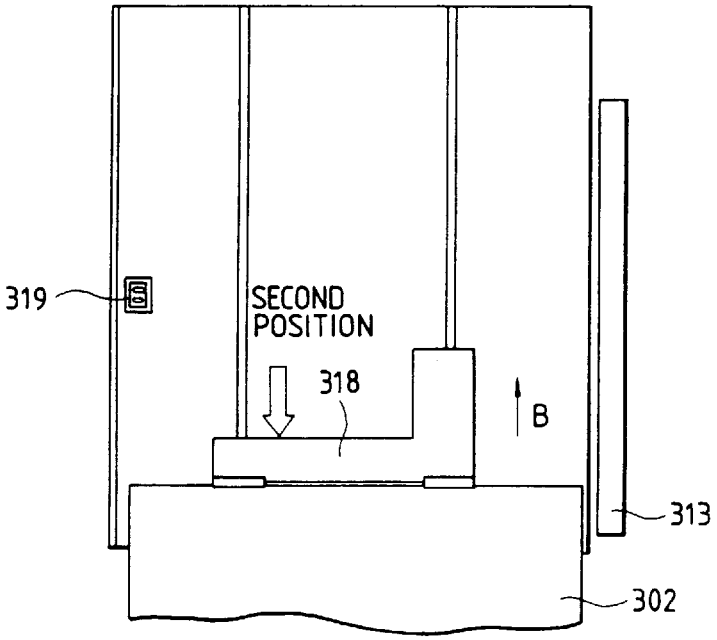
FIG. 22 PRIOR ART

Moreover, the other parts of the construction of this embodiment are the same as those of the conventional printer as shown in FIG. 8 and FIG. 9. Hence, their description is omitted here, with the same reference numbers indicated in the Figures.

Figure 41:
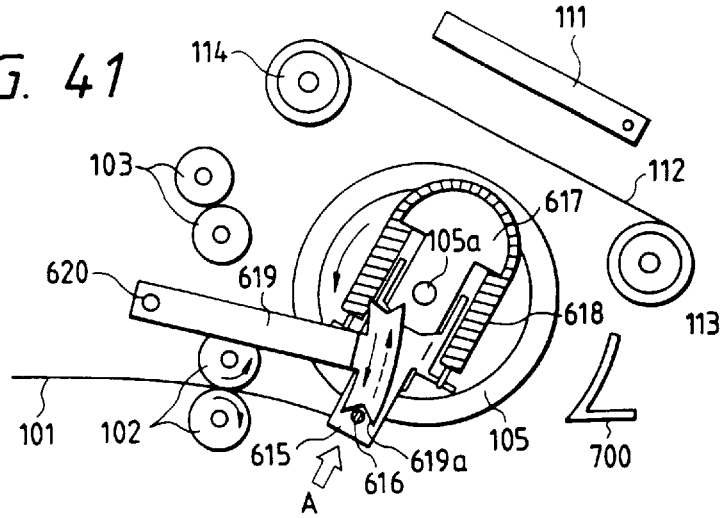

Next, a description is made of the operations. FIG. 41 shows the state of paper feeding. First, the platen roller 105 rotates in the direction shown by the arrow mark in a solid line, and the clamper 615 shifts its position to the first position A, which marks the point for feeding the paper. Next, the arm 619 is rotated in the direction shown by the arrow mark in a solid line with the driving mechanism composed of an arm 619, a motor 623, a worm gear 622, a worm wheel 621, etc., and the arm scoops up the clamper pin 616, thereby lifting up the clamper 615 along the guide bush 617. In this state, the recording paper 101 transported with the paper feeding roller 102 is inserted between the clamper 615 and the platen roller 105, and the recording paper 101 is clamped by the rotation of the swinging arm 619 in the direction indicated by the arrow mark in a dotted line. In the clamped state, the clamper 615 and the platen 105 move together in one block, and the recording paper 101 is wound around the platen roller 105.

Figure 42:
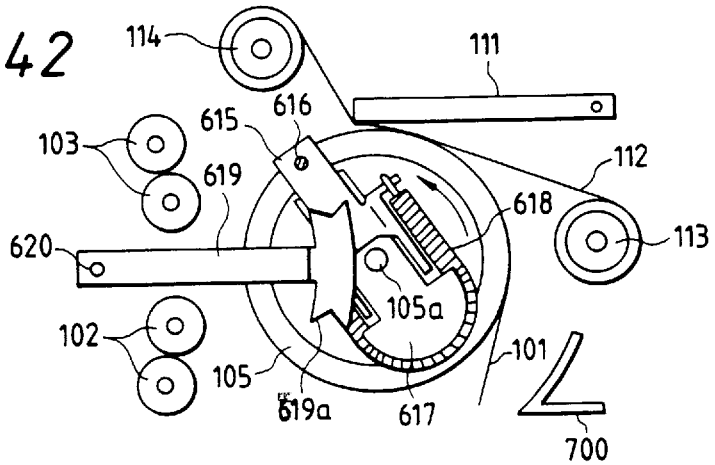

FIG. 42 shows the state of the transfer of images for printing, in which the thermal printing head 111 moves downward and pushes the ink sheet 112 onto the recording paper 101. In this state, the thermal printing head 111 generates heat when electric power is conducted to it, and the ink on the ink sheet 112 is thereby sublimated and sticks to the recording paper 101. Along with this, the platen roller 105 is put into rotation, and the ink transferring process is repeated three times for the three colors, yellow, magenta, and cyan, and a print is thereby produced. Moreover, the thermal printing head 111 escapes upward when the clamper 615 passes the position of the thermal printing head 111, so that the thermal printing head will not get into direct contact with the clamper 615. Moreover, the swinging arm 619 is on standby in the neutral position, so that it will not get into its direct contact with the clamper pin 616.

Figure 43:
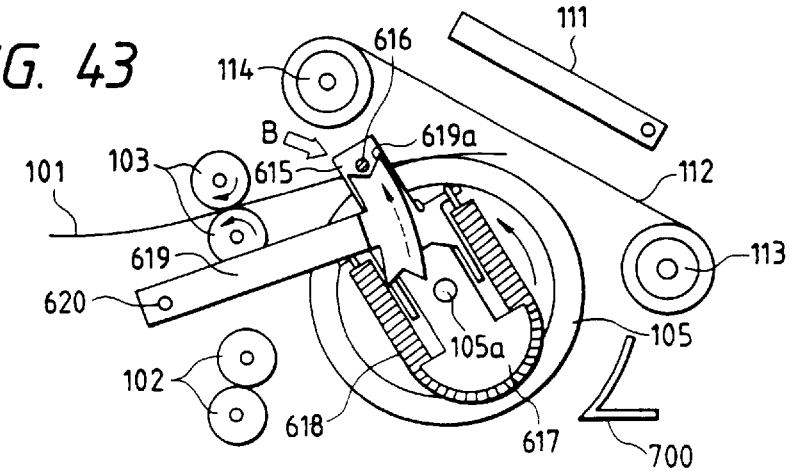

FIG. 43 shows the state of the discharge of paper. After the completion of the transfer of images for printing, the platen roller 105 moves in rotation in the direction shown by the shown by the arrow mark in a solid line, with which the clamper 615 shifts its position to the second position B, which marks the paper discharging point. Next, the swinging arm 619 is rotated in the direction indicated by the arrow mark in a dotted line with the driving mechanism and scoops up the clamper pin 616, and the clamper 615 is lifted again along the guide bush 617. With the clamp thus released, the platen roller 105 rotates by itself, and the recording paper 101 is transported to the paper discharging roller 103 by the thrusting pressure exerted by the thermal printing head 111. Now that the paper discharging roller 103 is kept in rotation in the direction indicated by the arrow mark in a solid line, and, when the paper discharging roller 103 grips on the recording paper 101, the thermal printing head 111 moves upward, and the recording paper 101 is discharged by the paper discharging roller 103 alone.

As described above, the printer according to the present invention is constructed in such a manner that the platen roller rotates by itself when it is kept away from the clamper but the clamper and the platen roller move together in one unified block when force is applied to the clamper to go into contact with the platen roller. It is possible to achieve the effect that the feeding of the recording paper and the discharge of the paper can be performed in arbitrarily selected positions on the circumference of the platen roller and that the paper pass can be set up freely.

In the foregoing part, a description has been made in respect of the normal operations in the second example of preferred embodiments according to the present invention, but, in the following part, the operations to be performed at the time of the occurrence of a jam of paper, with reference to FIG. 44 and FIG. 45.

Figure 44:
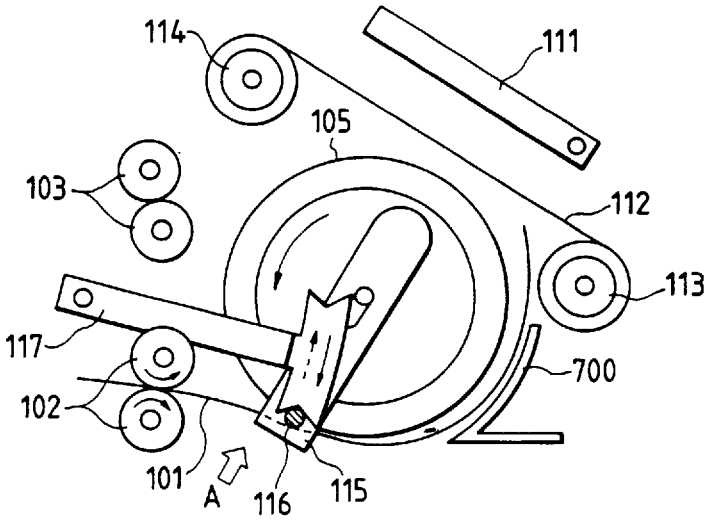
FIG. 44 and FIG. 45 are side views for use in explaining the operations to be performed at the time when a jam occurs in the second preferred embodiment of the present invention.
Figure 45:
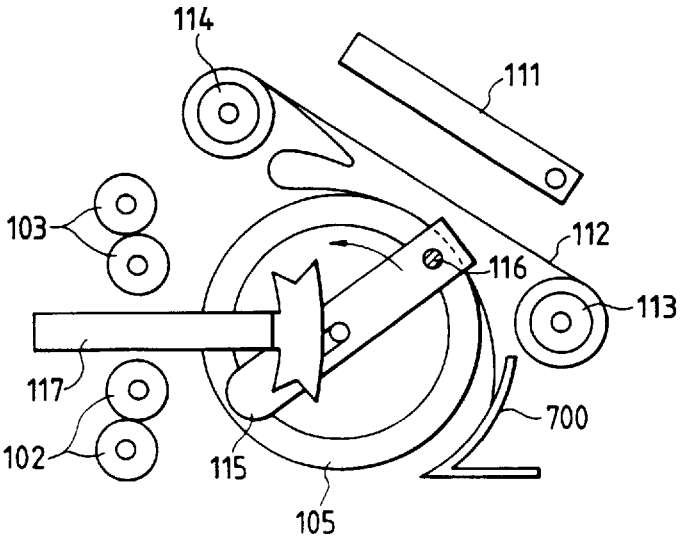

In case the recording paper 101, which is fed by the paper feeding block 102, fails on account of some trouble to stop in the prescribed clamping position A, the recording paper 101 moves into the parts around the platen roller 105 along the paper guide 700, as shown in FIG. 44. In case the paper is clamped further in that position with the platen roller in rotation, there occurs a state of paper jamming, as shown in FIG. 45, with the top edge of the recording paper 101 being caught in its direct contact with the ink sheet 112, and it is feared that this state either causes damages to the ink sheet, or develops into a more complicated jam.

Since the printer in the second example cited above, the printer is constructed as described above, it is beyond any estimate where the top edge of the paper will run once its disorderly run happens at the time of paper feeding, and it is therefore considered that the printer presents problems in that it becomes impossible to take out the jammed paper and that the ink sheet is damaged in the event a jam has occurred.

The fourth embodiment has been developed with a view to working out a solution to such problems as those mentioned above, and the object of this embodiment consists in offering a printer which enables the above-mentioned processing of a jam with ease even if a jam has occurred at the time of paper feeding.

The printer in the fourth embodiment is a printer provided with a paper guide for guiding the paper fed from the paper feeding portion to the paper discharging portion by way of a platen roller provided on the way, wherein the paper guide is a paper guide with a hook-shaped protrusion formed thereon and with the paper guide mentioned above being arranged between the position for the feeding of paper and the position for the start of the image transferring operation, with the protrusion in the shape of a hook being set in its orientation towards the platen roller mentioned above.

The paper guide in this example of embodiment is constructed in such a way that the top edge of the recording paper runs against the hook-shaped protrusion provided on the paper guide, in case the top end of the paper comes into the printer along the paper guide, with a trouble occurring at the time when the paper is fed into the equipment, and a jam occurs then and there, so that the processing of the jammed paper after the occurrence of the jam can be performed with ease.

Figure 46:
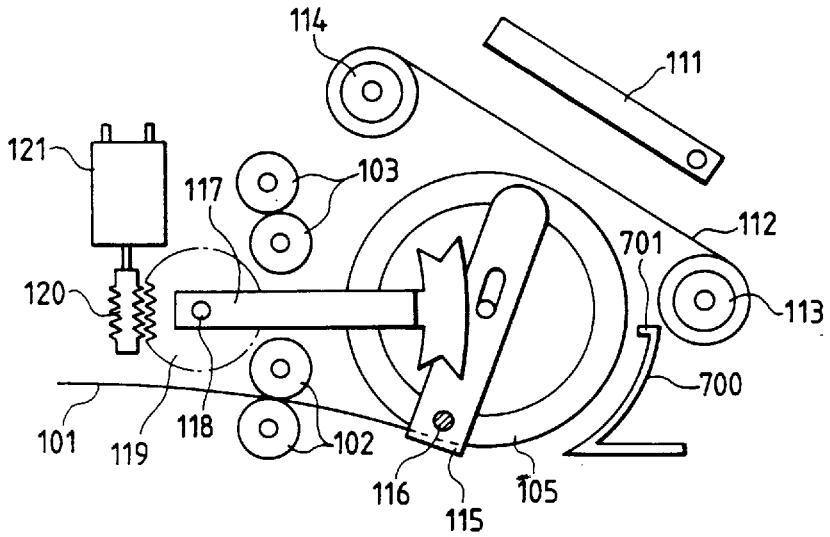
FIG. 46, FIG. 48, and FIG. 49 are respectively charts illustrating the printer according to the fourth preferred embodiment of the present invention, FIG. 46 being a schematic construction drawing, FIGS. 47(*a*)–47(*e*) being perspective views showing the various kinds of constructions of the paper guide shown in FIG. 46, and FIG. 48 and FIG. 49 being side views of the principal parts for use in description of the operations to be performed at the time of the occurrence of a jam.
Figure 47A:
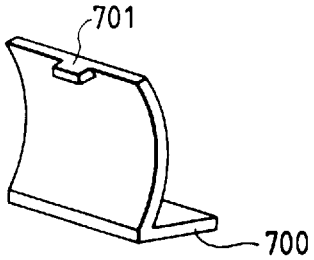
Figure 47B:
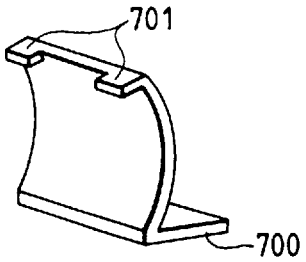
Figure 47C:
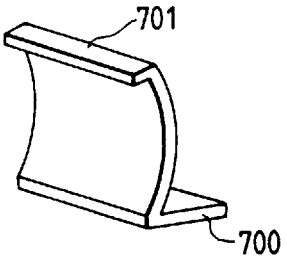
Figure 47D:
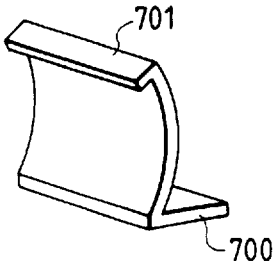
Figure 47E:
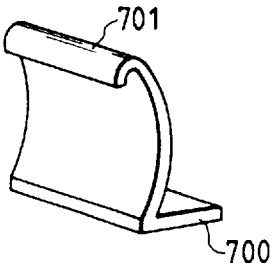

In the following part, the fourth example of the preferred embodiments is explained with reference to the accompanying drawings. FIG. 46 is a schematic construction drawing showing the printer in this fourth example of embodiment.

In this Figure, the other parts in the construction, which are the same as those in the second example of embodiment, are indicated with the same reference numbers, and their detailed description is omitted here.

The reference number 700 represents the paper guide which guides the recording paper 101 and brings the paper in line with the platen roller 105, and this paper guide is provided with a hook-shaped protrusion 701 at the top.

FIGS. 47 (*a*) through (*e*) respectively illustrate examples of embodiment of the paper guide 700 mentioned above, and FIG. 47 (*a*) shows such a paper guide with a hook-shaped protrusion 701 formed in the center of the top part of the paper guide 700, and FIG. 47 (*b*) shows such a paper guide provided with such a hook-shaped protrusion on both sides of the paper guide. FIGS. 47 (*c*) and (*d*) show such a paper guide with the entire top part thereof formed into a hook shape, and FIG. 47 (*e*) shows such a paper guide with the hook-shaped protrusion formed with a round contour. These paper guides produce the same effect regardless of whichever one of these shapes is used.

Next, a description is made of the operations of the printer in this embodiment.

The operations of the printer in time of its normal operation are omitted from the description made here since they are the same as those in the second example of embodiment.

The operations to be performed at the time of the occurrence of a jam are now described with reference to FIG. 48 and FIG. 49.

Figure 48:
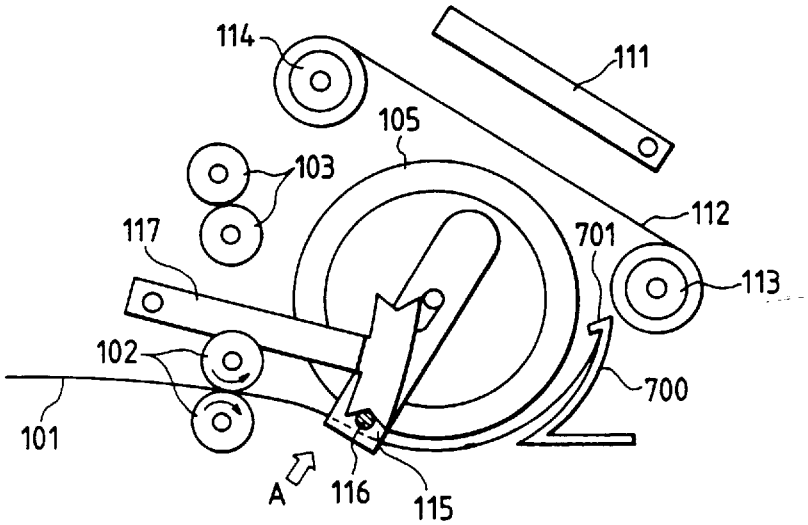
Figure 49:
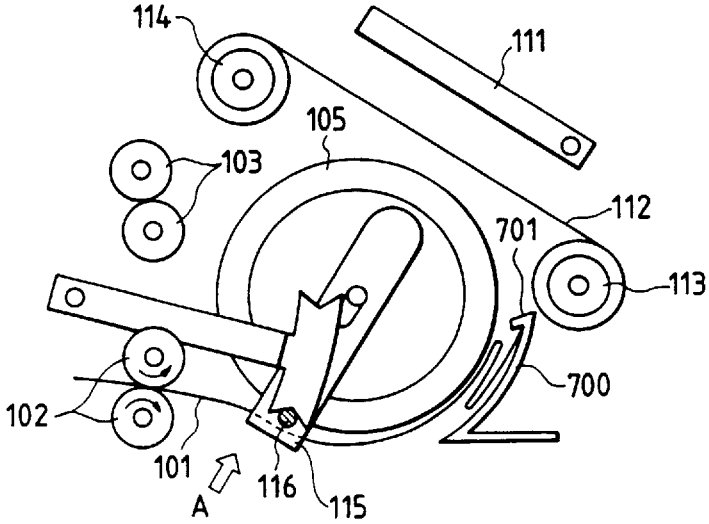

In case the recording paper 101 runs in a disorderly way after it is fed into the equipment with the paper feeding portion (i.e. the paper feeding roller) 102, not coming to a halt in the prescribed clamping position A, the top edge of the recording paper 101 is transported along the paper guide 700, as shown in FIG. 48, and gets into its direct contact with the hook-shaped protrusion on the paper guide 700. If the recording paper 101 is carried further forward, then the top edge of recording paper 101 is lodged on the hook-shaped protrusion 701. Thus, the recording paper 101 is put into the state of a jam on the spot, but the recording paper 101 will not go any further into the mechanism.

As described above, the printer in this example of embodiment makes it possible specifically to locate the position where a jam has occurred and to remove the lodged recording paper immediately, even if a jam occurs at the time of paper feeding because the printer has a paper guide provided with a hook-shaped protrusion formed thereon.

Figure 50:
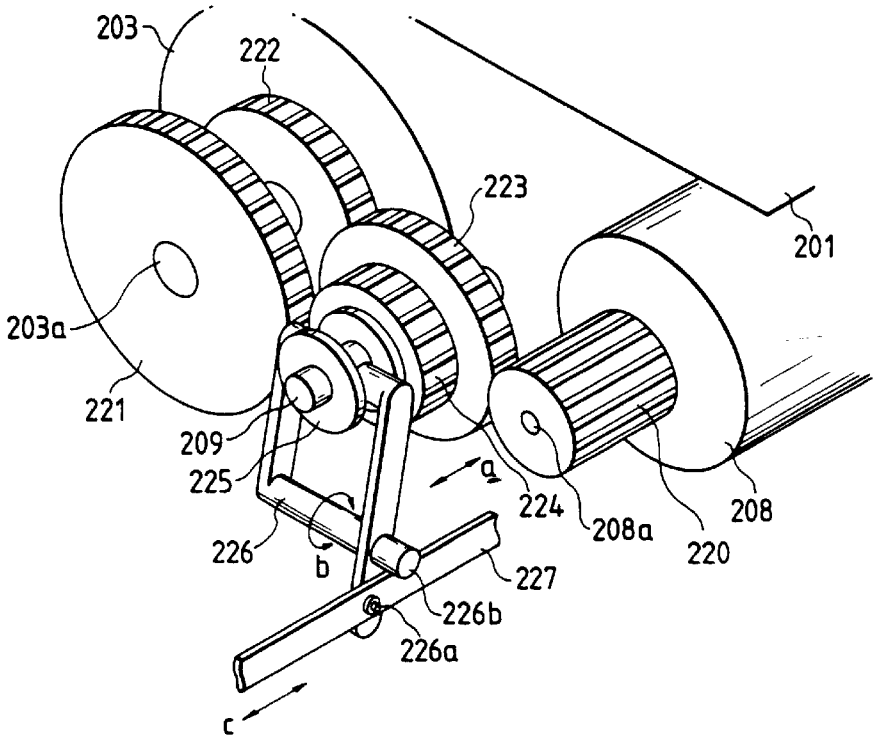
FIG. 50 is a chart illustrating the principal parts in enlarged dimensions for the fifth preferred embodiment of the present invention.

FIG. 50 is a drawing illustrating the principal parts in enlarged dimensions with respect to the fifth example of embodiment of the present invention. In this Figure, the reference number 201 through 209 indicate those parts which are either the same as or corresponding to the parts present in the example of the conventional printer described above. These are therefore merely shown with their reference numbers, and they are omitted from the description given here. The reference number 220 indicates the driving gear mounted axially on the motor shaft 208*a* mentioned above, 221 denotes the platen gear fixed axially on the platen shaft 203*a*. The reference number 222 shows the platen gear positioned between the above-mentioned platen roller 203 and the above-mentioned platen gear 221 and fixed axially on the platen shaft 203*a* mentioned above. The reference number 223 indicates the intermediate gear supported in a manner to permit its free rotating motion round the above-mentioned gear shaft 209 as the center of its rotation, and this intermediate gear is in its constant meshing with the driving gear 220 mentioned above and can thus be put into its sliding movement on the above-mentioned gear shaft 209 and thereby brought into meshing also with the platen gear mentioned above. The reference number 224 shows the intermediate gear supported in a manner permitting its free rotating motion round the above-mentioned gear shaft 209 as the center of its rotation, and this intermediate gear can be put into its sliding movement in the direction indicated by the arrow mark a on the above-mentioned gear shaft 209 and can be brought thereby into its meshing with the platen gear 221 mentioned above. The reference number 225 shows the rim which is supported in such a manner as to permit its free rotating motion round the above-mentioned gear shaft 209 as the center of its rotation, and this rim can be put into its sliding movement in the direction indicated by the arrow mark a on the above-mentioned gear shaft 209. Here, the intermediate gears 223 and 224 mentioned above and the rim 225 mentioned above move together in a unified block either in their rotation or in their sliding movement. The reference number 226 indicates the lever, which has a protruding part 226*a*, can rotate in the direction indicated by the arrow mark b round the supporting shaft 226*b*, and one end of it is engaged in the rim 225 mentioned above. The reference number 227 indicates the lever which is held on the protruding part 226*a* mentioned above and moves in parallel in the direction indicated by the arrow mark c by the driving force not illustrated in the Figure.

The rim 225 mentioned above and the levers 226 and 227 mentioned above together form the clutch mechanism. By making the above-mentioned lever 227 move in parallel in the direction indicated by the arrow mark c, the lever 226 is rotated in the direction indicated by the arrow mark b around the supporting shaft 226*b*. The rim 225 and the intermediate gears 223 and 224 move together in the direction indicated by the arrow mark a on the gear shaft 209. This changes the combination of the meshing between the intermediate gears 223 and 224 and the platen gears 221 and 222 mentioned above between two states. The first state is where the intermediate gear 223 mentioned above and the platen gear 222 mesh with each other but the intermediate gear 224 mentioned above and the platen gear 221 do not mesh. The second state is when the intermediate gear 223 mentioned above and the platen gear 222 do not mesh with each other but the intermediate gear 224 mentioned above and the platen gear 221 do mesh with each other.

The modules for the driving gear 220 mentioned above, the intermediate gears 223 and 224 mentioned above, and the platen gears 221 and 222 mentioned above are all identical to one another, and these five gears together comprise the speed reduction, driving, and transmission mechanism. When it is assumed, for example, that there are 22 teeth on the driving gear 220, 88 on the intermediate gear 223 mentioned above, 59 on the intermediate gear 224 mentioned above, 118 on the platen gear 221 mentioned above, and 89 on the platen gear 222 mentioned above, the speed reduction ratio between the driving gear 220 mentioned above and the intermediate gear 223 mentioned above will be 4 and the speed reduction ratio between the intermediate gear 224 mentioned above and the platen gear 221 mentioned above will be 2. Both of these ratios are integral numbers. However the speed reduction ratio between the intermediate gear 223 mentioned above and the platen gear 222 mentioned above will be 89/88; this ratio is not an integral number.

Figure 1:
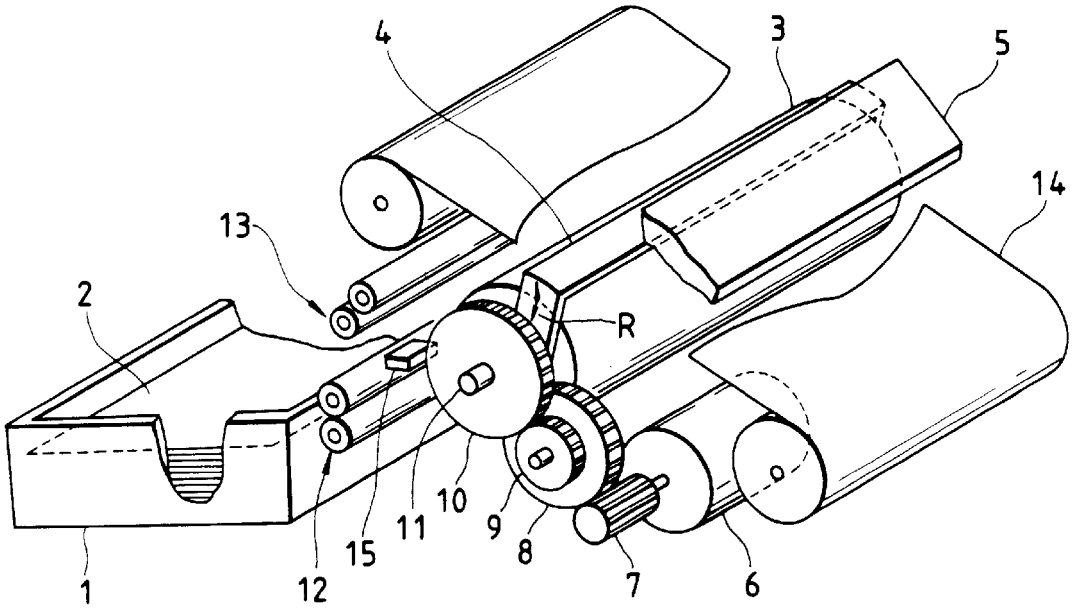
FIG. 1 PRIOR ART
FIG. 1 is a chart illustrating the construction of a conventional printer.
Figure 5:
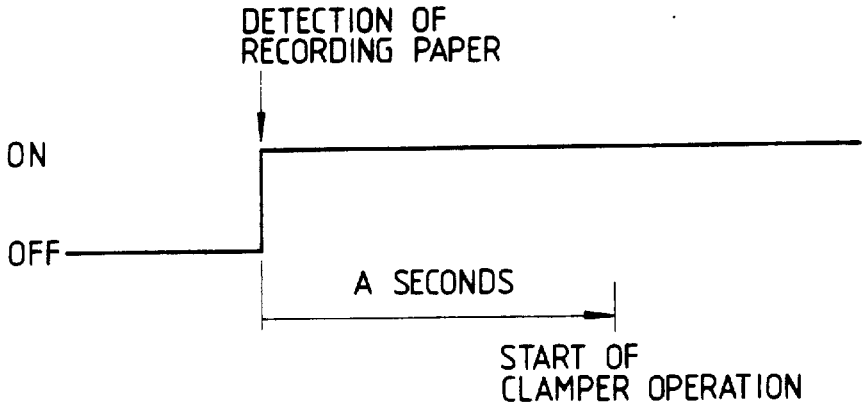
FIG. 5 PRIOR ART
FIG. 5 is a chart illustrating the operations of the conventional paper detecting sensor.

Now, the operations of the printer in the construction as described above is made with reference to FIG. 51 through FIG. 54. However, the clutch mechanism shown in FIG. 1 is not shown in FIG. 51 through FIG. 54.

Figure 2:
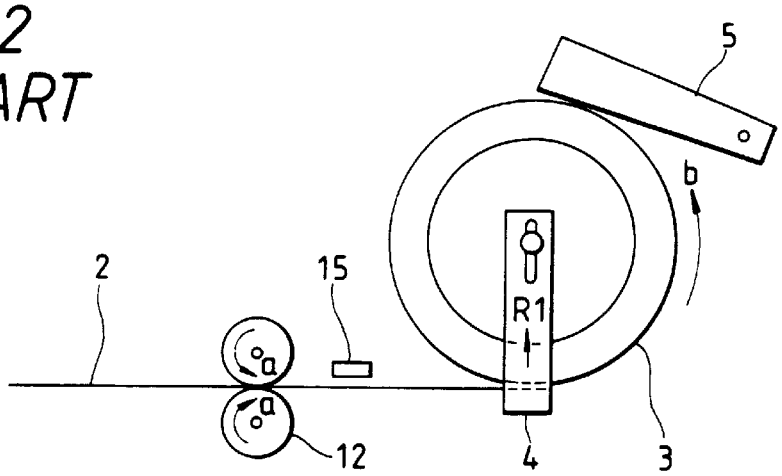
FIG. 2 PRIOR ART
FIG. 2 through FIG. 4 are charts respectively illustrating the operations of the conventional printer.
Figure 3:
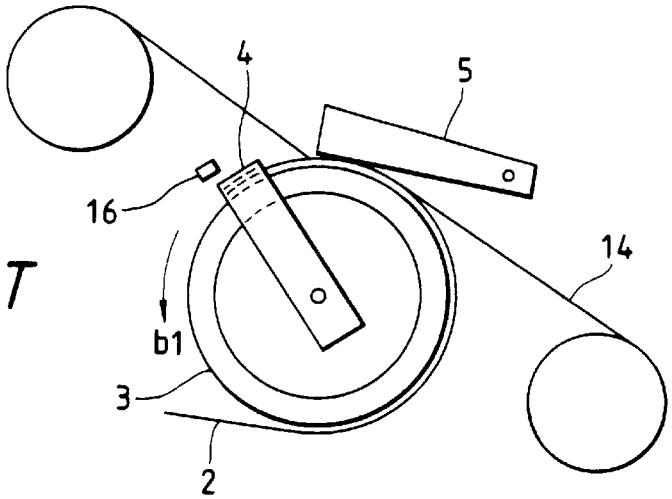
FIG. 3 PRIOR ART
Figure 4:
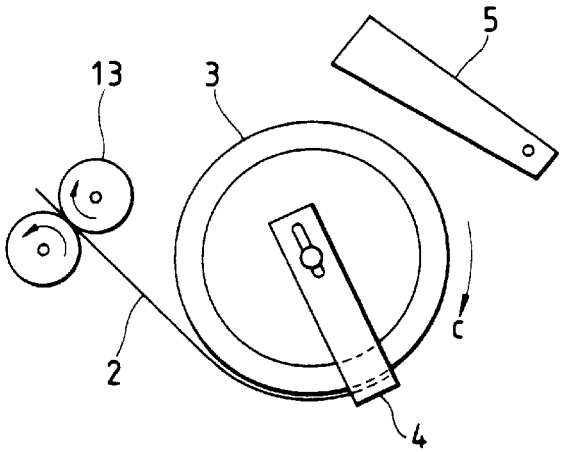
FIG. 4 PRIOR ART
Figure 6:
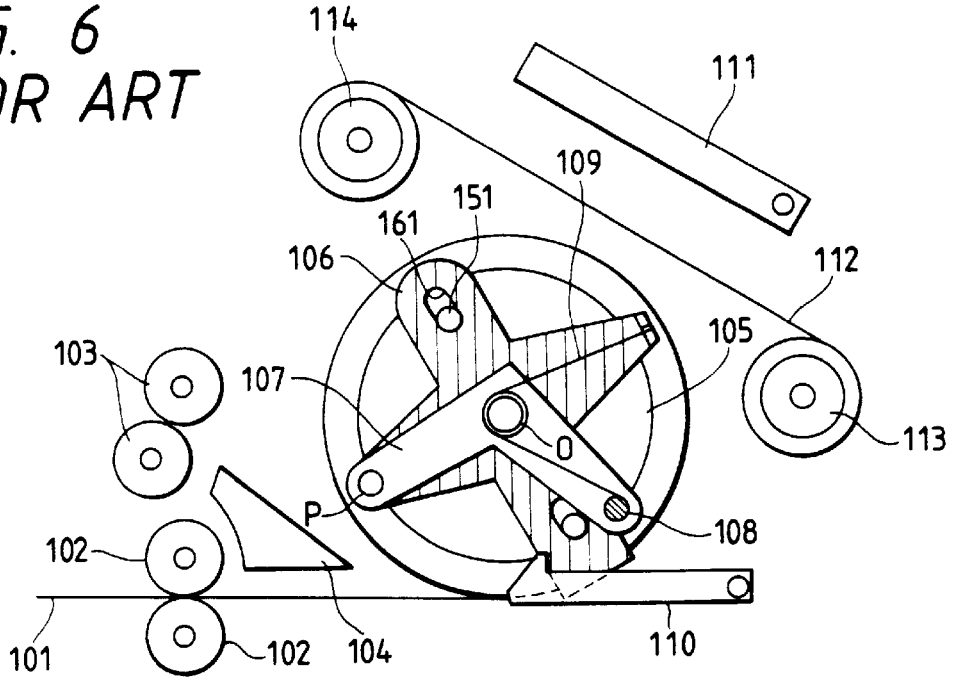
FIG. 6 PRIOR ART
FIG. 6 and FIG. 9 are respectively drawings illustrating a second conventional printer, FIG. 6 being a schematic side view.
Figure 7:
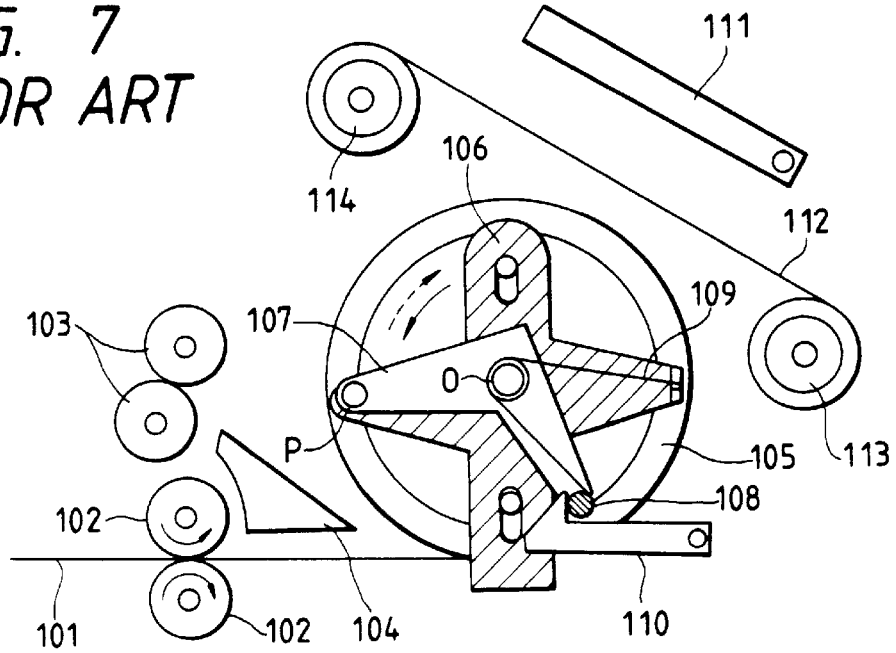
FIG. 7 PRIOR ART
Figure 51:
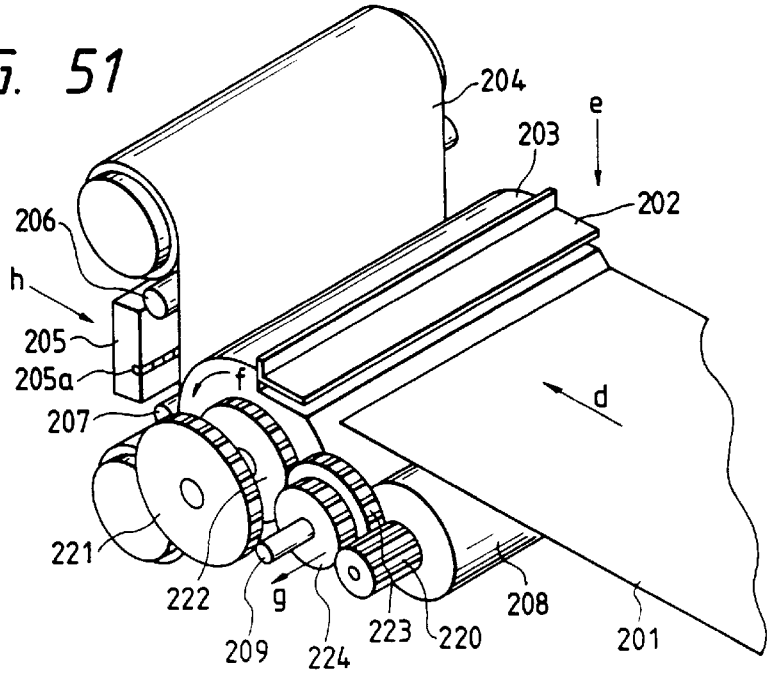
FIG. 51 is a perspective view illustrating the state of paper feeding in the operations of the printer in this preferred embodiment of the present invention.
Figure 52:
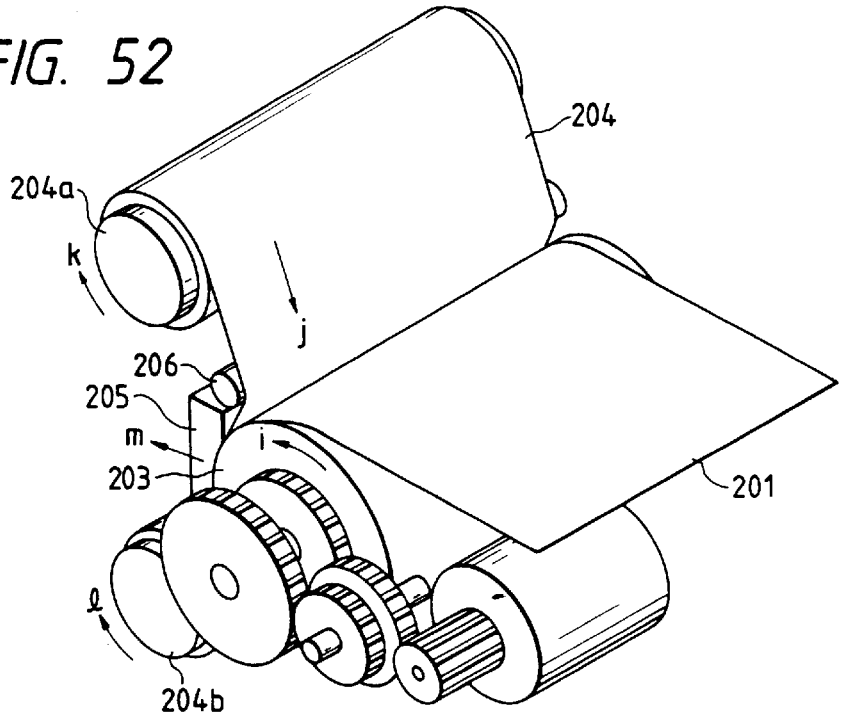
FIG. 52 is a perspective view illustrating this preferred example of embodiment in the state of the start of registration in printing in its operation.

First, the state of paper feeding is shown in FIG. 51. When the intermediate gear 223 meshes with the driving gear 220 and the platen gear 222, the thermal printing head 205 and the guide rollers 206 and 207 are aloof from the platen roller 203, and the clamp 2 is in the position shown in FIG. 2 on the platen roller 203. The recording paper 201 is transmitted in the direction indicated by the arrow mark d, the clamp 202 is moved in the direction indicated by the arrow mark e as it captures the said recording paper by its top edge. Subsequently, the rotating force of the motor 208 is transmitted to the platen gear 222 via the driving gear 220 and the intermediate gear 223, and, as a result, the platen roller 203 rotates in the direction indicated by the arrow mark f and the top edge of the recording paper 201 comes to the prescribed position for the start of the registering operation in the proximity of the thermal printing head 205. Then, the motor 208 stops its revolution, and the platen roller 203 temporarily stops its rotation and the intermediate gears 223 and 224 proceeds in sliding motion on the gear shaft 209 in the direction indicated by the arrow mark g by the action of the clutch mechanism not shown in the Figure, and the intermediate gear 224 and the platen gear 221 go into meshing with each other. At this moment, the part of the ink in the first color, yellow, for the start of registration has come to the position where the ink sheet 204 faces the heat generating element 205*a*. Then, the thermal printing head 205 and the guide rollers 206 and 207 move in the direction indicated by the arrow mark h, and the heat generating element 205*a* is pushed under pressure against the platen roller 203 with the ink sheet 204 and the recording paper 201 present between them. This state is illustrated as the state for the start of registration in FIG. 52.

Next, the platen roller 203 rotates in the direction indicated by the arrow mark i, with which the recording paper 201 and the ink sheet 204 are transported as held in close contact with each other in the direction indicated by the arrow mark i, and, at the same time, the signals on the images to be printed in yellow are transmitted to the thermal printing head 205 in synchronization with the transporting speed for the recording paper 201, and the heat generating elements (205*a*) not shown in the Figure are selectively activated to generate heat in regular sequence and to transfer the yellow ink onto the recording paper 201 to record the images in yellow. In this process, the ink sheet feeding reel 204*a* rotates in the direction indicated by the arrow mark k, giving adequate tension to the ink sheet 204 in its movement in the direction indicated by the arrow mark j, and the ink sheet take-up reel 204*b* rotates in the direction indicated by the arrow mark l while winding up the ink sheet 204.

Figure 53:
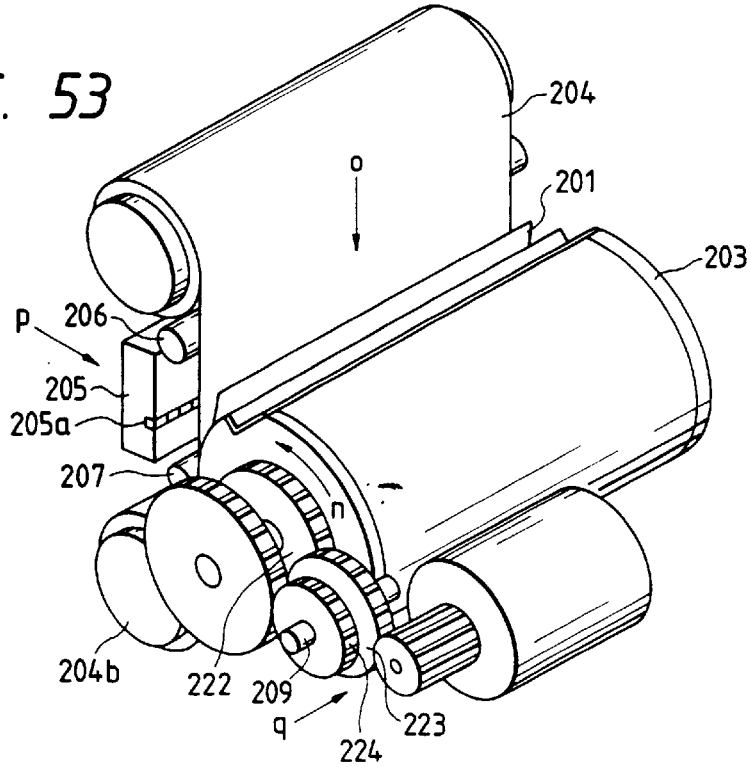
FIG. 53 is a perspective view illustrating the state of the completion of the registration in printing in the operation of this preferred embodiment.

When the registration of the images in yellow is finished with the operations described above, the platen roller 203 comes to a temporary stop of its rotating motion, and the thermal printing head 205 and the guide rollers 206 and 207 (not illustrated in the Figure) shift their positions in the direction indicated by the arrow mark m and thereby move away from the platen roller 203. This state is shown in FIG. 53 as the state of the completion of registration.

Figure 54:
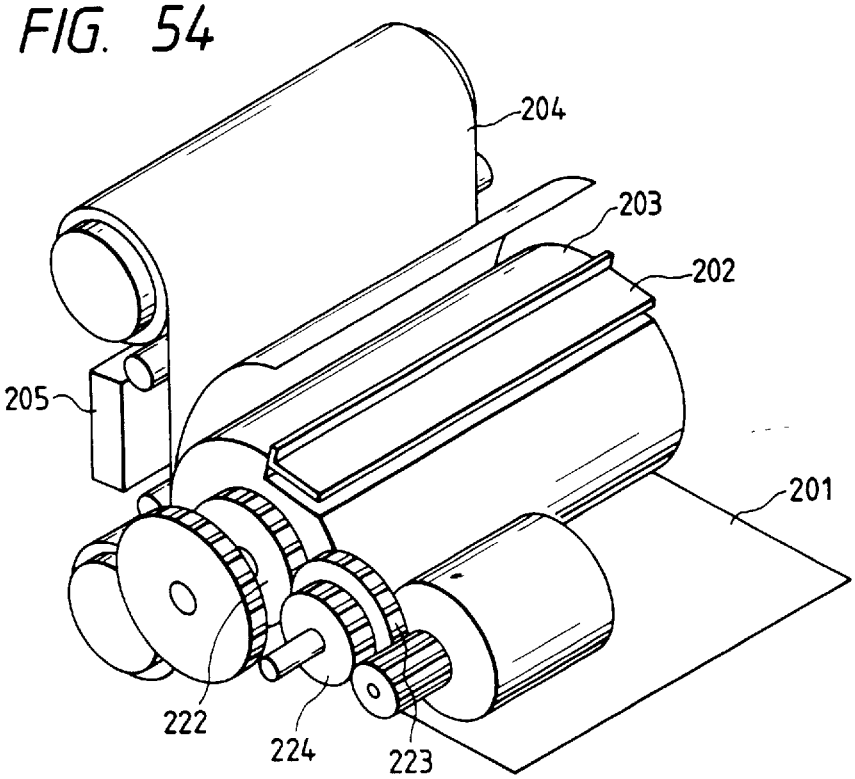
FIG. 54 is a perspective view illustrating the state of paper discharge in the operations of this preferred embodiment.

After this, when the platen roller 203 rotates in the direction indicated by the arrow mark n and the top edge of the recording paper 201 comes again to the same position as that for the start of registration of the images in yellow, the platen roller 203 comes to a temporary stop. In the meantime, the ink sheet 204 is transported by the ink sheet take-up reel 204*b* in the direction indicated by the arrow mark o for a prescribed duration of time, and, when the part for the start of registration of the ink sheet with the second color, magenta, coated thereon comes to the position facing the heat generating element 205*a*, the sheet take-up reel 204*b* stops its rotation. After the operations mentioned above as shown in FIG. 53 are finished, the thermal printing head 205 and the guide rollers 206 and 207 shift their positions in the direction indicated by the arrow mark p, and the heat generating element 205*a* is brought into close contact with the platen roller via the ink sheet 204 and the recording paper 201. And, with the rotation of the platen roller 203, the thermal printing head record the images in magenta in overlapping with the images already registered in yellow. Upon the completion of the registration of the images in magenta, the printer registers the images in cyan in the same manner in overlapping with the already registered images and completes the process for the registration of the images in color. When the registration of the images in color is thus completed, the intermediate gears 223 and 224 proceeds in sliding motion in the direction indicated by the arrow mark q on the gear shaft 209 by the action of the clutch mechanism not shown in the Figure, and the intermediate gear 223 and the platen gear 222 are set into their meshing, in the same way as at the time of paper feeding, and the gears in this state put the platen roller 203 into its rotating motion and, when the platen roller comes to the prescribed position, it shifts the clamper 202 to release the fore edge of the recording paper 201, and the discharge of the paper is performed. This state is shown in FIG. 54 as the state of paper discharge.

The present invention proposes a construction of a printer as described above, and, by changing the combination of the meshing of the individual gears only at the time of paper feeding and at the time of paper discharging, the printer can change the relations for the relative positions in the meshing of the individual gears for the registration of colors in the next cycle of operations, thereby attaining a reduction in the irregular wear of the individual gears, also a reduction of the irregular rotation of the gears resulting from their irregular wear, and ultimately prolonging the service life of the individual gears.

In the following part, the sixth example of the preferred embodiments according to the present invention is explained with reference to FIG. 55 through FIG. 57.

Figure 55:
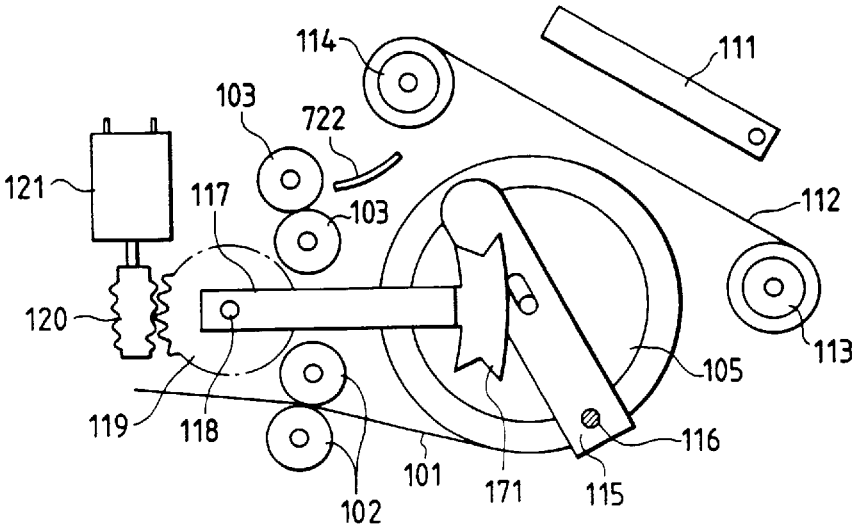
FIG. 55 is a schematic side view illustrating the sixth preferred embodiment of this present invention.
Figure 56:
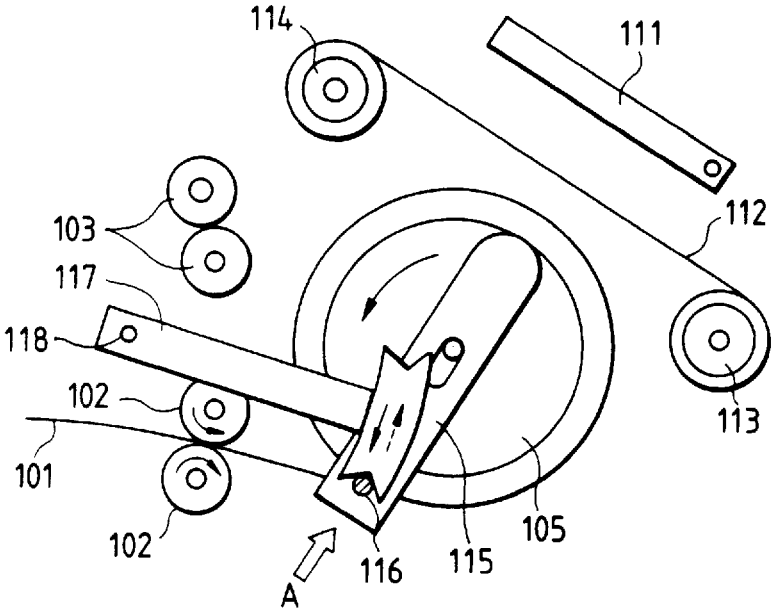
FIGS. 56 through 59 are side views illustrating the principal parts in the description of the operations.
Figure 57:
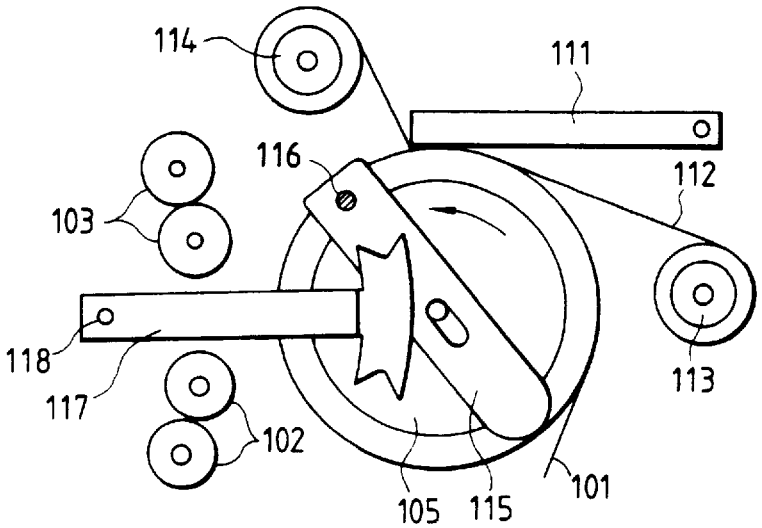

Specifically, in FIG. 55 through FIG. 57, the reference number 115 represents the clamper which pushes the recording paper 101 under pressure onto the platen roller 105 and holds the paper in place, the reference number 116 indicates the clamper pin formed in a form protruding from the side of the clamper 115, and the reference number 117 shows the swinging arm having a V-shaped groove 171 at its top. The reference number 118 denotes the synchronizing shaft which achieves the synchronization of the left and right swinging arms. The reference number 119 stands for the worm wheel for transmitting the motor power to the synchronizing shaft 118, and the reference number 120 represents the worm gear which, being driven with the motor 121 capable of running forward and in reverse, meshes with the work wheel 119, meshes with the worm wheel 119. The reference number 722 shows the paper guide arranged ahead of the paper discharging roller. Here, the turning direction of the swinging arm 117 is changed by the change of the rotating direction of the motor 121.

Moreover, the swinging arm 117 is constructed with a bend in the middle part in a crank shape, so that it can avoid the clamper pin 116 in its rotating motion.

The other parts in the construction of this embodiment are omitted from the description made here since they are the same as those of the conventional printer shown in FIG. 6 through FIG. 9.

With the mechanism thus constructed, the platen roller 105 first rotates in the direction shown by the arrow mark in a solid line, as illustrated in FIG. 55, and the clamper 115 moves to the first position, point A, which is the point for feeding the paper. Next, the swinging arm 117 is rotated in the direction shown by a solid line with the driving mechanism composed of the motor 121, the worm gear 120, the worm wheel 119, etc. and lifts up the clamper 115 by scooping up the clamper pin 116. Thereupon, the recording paper 101 comes transported by the paper feeding roller 102 and is inserted between the clamper 115 and the platen roller 105, and, with the turning motion of the swinging arm 117 in the direction indicated by the arrow mark in a dotted line, the recording paper 101 is clamped. Then, the platen roller 105 moves in rotation and winds up the recording paper 101.

Thereafter, the thermal printing head 111 moves down, as shown in FIG. 56, which illustrates the state of the printing process, and pushes the ink sheet 112 onto the recording paper 101. When electric power is conducted to the thermal printing head 111 while it is in this state, the thermal printing head 111 generates heat, by which the ink on the ink sheet 112 is sublimated and sticks to the recording paper 101. The printing of images in color is executed with this operating process repeated three times, one each for the three colors, yellow, magenta, and cyan, by applying the sublimated ink with the platen roller 105 kept in its rotating motion. Moreover, the thermal printing head 111 temporarily escapes upward when the clamper 115 passes the position of the said thermal printing head 111, so that the said thermal printing head will not go into its direct contact with the clamper 115. Also, at the time of printing, the swinging arm 117 stands by in the neutral position, so that it will not go into its direct contact with the clamper pin 116 in the course of this process.

FIGS. 56 through 59 illustrate the state of the discharge of paper. First, as shown in FIG. 56, the platen roller 105 rotates in the direction indicated by the arrow mark in a solid line after the completion of the transfer of images, and the clamper 115 moves to the second position, i.e. point B.

Figure 58:
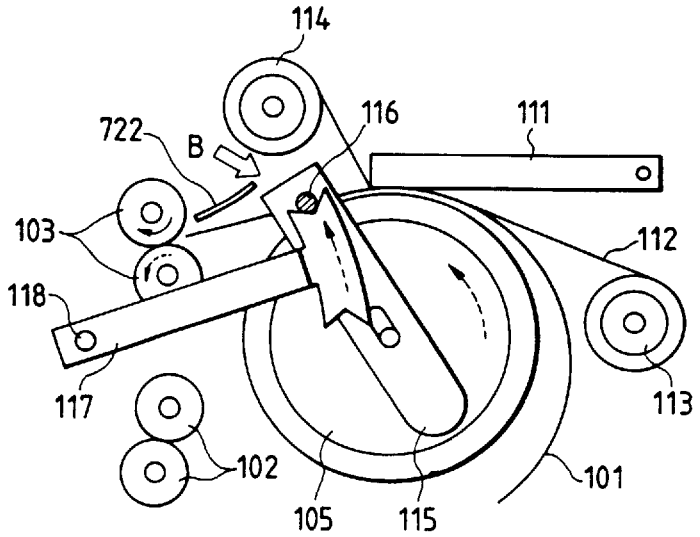
Figure 59:
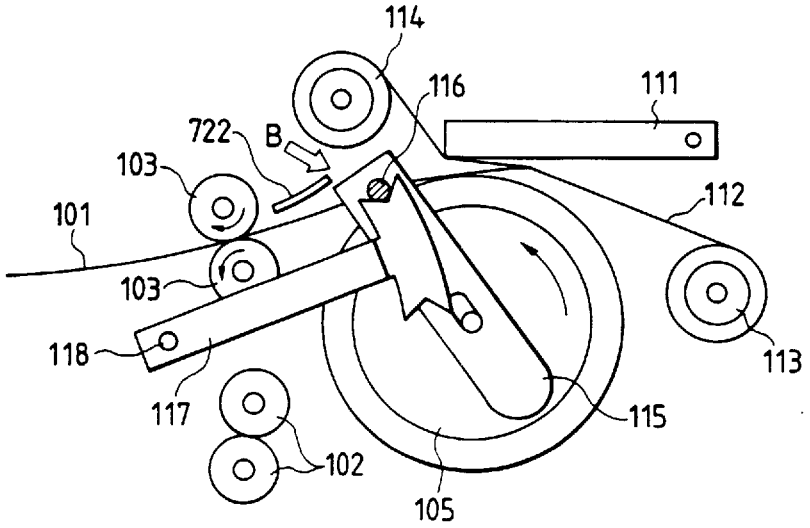

Next, as shown in FIG. 58 the swinging arm 117 turns in the direction indicated by the arrow mark in a dotted line, being driven by the driving mechanism, and lifts up the clamper 115 by scooping up the clamper pin 116, and stops in the position for discharging the paper in the proximity of a paper guide 722. When the clamper is thereby released, the recording paper 101, being guided by the guide composed of the paper guide 722 and the clamper 115, is transported through the slit between the clamper 115 and the platen roller 105 to the paper discharging roller 103 by the thrusting pressure of the thermal printing head 111. Turning to FIG. 59, paper discharging roller 103 rotates in the direction indicated by the arrow mark in a solid line, and, when the said roller grips the recording paper 101, the thermal printing head 111 moves upward to a height in the range from 5 to 15 mm, thereby assuming the state shown in FIG. 57, and the recording paper 101 is thereafter discharged solely by the paper discharging roller. At this time, the recording paper can be discharged with certainty since it is guided by the paper guide 722, the clamper 115, and the head 111.

Moreover, the recording paper can be discharged with greater certainty if the mechanism according to the above-mentioned example of embodiment is so constructed with the clamper 116 and the paper guide 722 overlapping with each other in the paper discharging position.

As described so far, the printer according to the present invention is so designed as to discharge the recording paper by guiding the paper with the lifted clamper, the paper guide, and the thermal printing head, the paper handling mechanism of this printer features higher reliability.

Figure 60:
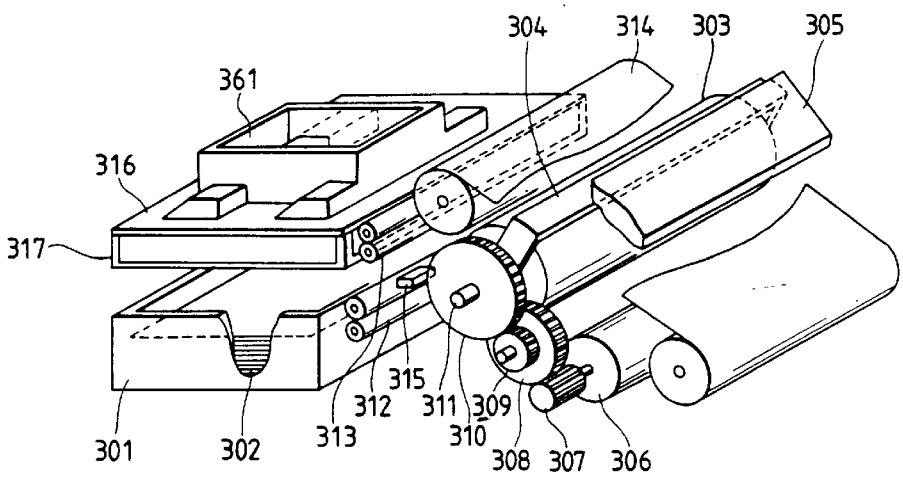
FIG. 60 is a perspective view illustrating the printer in the seventh preferred embodiment of the present invention.

In the following part, a description is made of the seventh example of the preferred embodiments of the present invention. FIG. 60 is a perspective view showing the printer in the seventh example of preferred embodiments of the present invention. In this Figure, the reference number 361 represents the opening made in the upper cover 316 for the paper discharging mechanism, and this opening is made smaller than the dimensions of the recording paper 302. Moreover, since the other parts of the construction of this embodiment are the same as those of the conventional printer shown in FIGS. 14–22, their description is omitted here.

Figure 61:
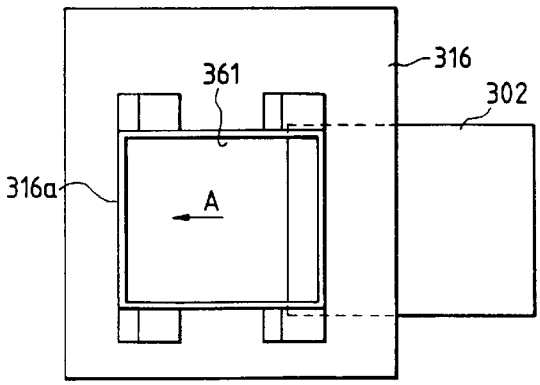
FIGS. 61 and 62 are top views of the paper discharging mechanism for the description of the operations of the paper discharging mechanism.
Figure 62:
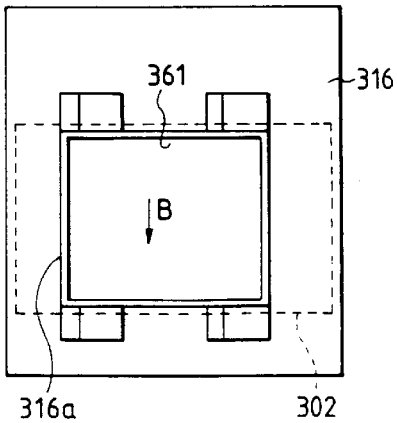

Next, a description is made of the operations of the printer in this embodiment of the present invention. However, as the basic operations are the same as those in the example of the conventional printer, their description is omitted here. In case a paper jam has occurred inside the paper discharging mechanism, the mechanism according to the present invention makes it possible to remove the jammed recording paper with ease by moving the recording paper in the direction A shown in FIG. 61 with a hand put into the mechanism through the opening 361 provided in the paper discharging mechanism and subsequently, when the paper is put into the state shown in FIG. 62, by moving the said paper in the direction B.

The dimensions of the opening 361 in the upper cover are set smaller than the dimensions of the recording paper, and it is thus made possible constantly to guide the four corners of the recording paper 301 with the upper cover 316. This feature eliminates the paper jams likely to be otherwise caused by the provision of the opening 361.

In addition, the enlargement of the dimensions of the opening 361 to a size somewhat smaller than the dimensions of the recording paper 302 makes it possible to prevent the occurrence of the phenomenon that the recording paper sticks to the upper cover 316 of the paper discharging mechanism by the effect of static electricity generated on the recording paper after the transfer of images to it and therefore makes it possible to discharge the recording paper in an unfailing way.

Furthermore, a cylinder-shaped guide **316*a* is provided in the opening of the mechanism according to the present invention. This structure prevents the hand from its accidental insertion into the dangerous parts, such as the high tension blocks, when the hand is put into the mechanism. Guide 316*a* also serves the purpose of strengthening the rigidity of the upper cover 316** of the paper discharging mechanism.

As mentioned above, the seventh example of preferred embodiments according to the present invention is provided with an opening in the upper cover of the paper discharging mechanism, so that it is possible easily to remove the jammed paper in case a jam has occurred inside the paper discharging mechanism and also offers the advantageous effect of preventing the recording paper from sticking to the upper cover of the paper discharging mechanism by the action of static electricity developed on the paper after the transfer of images to it.

Figure 23:
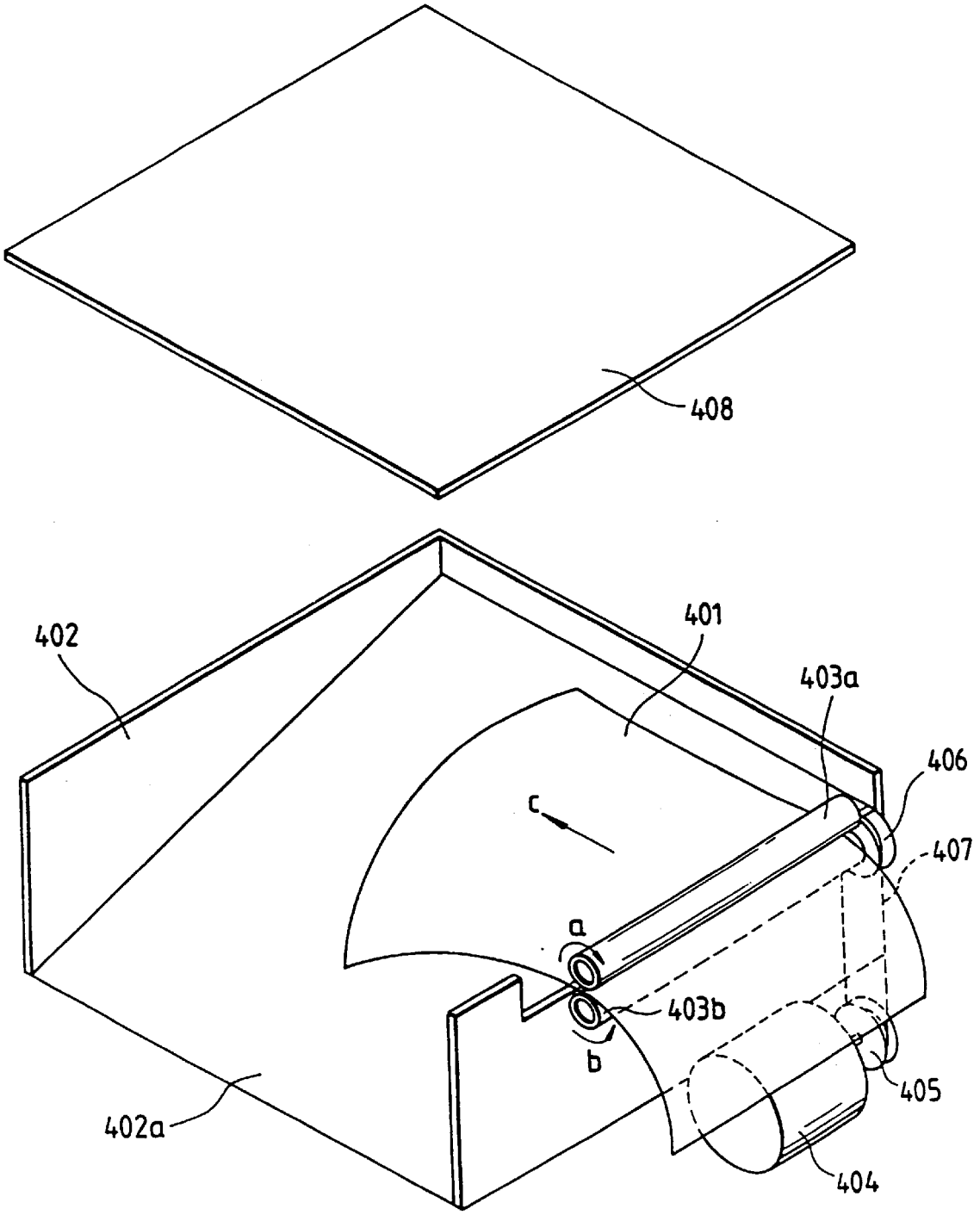
FIG. 23 PRIOR ART
FIG. 23 is a perspective view illustrating the paper discharging mechanism in a fifth conventional printer.
Figure 24:
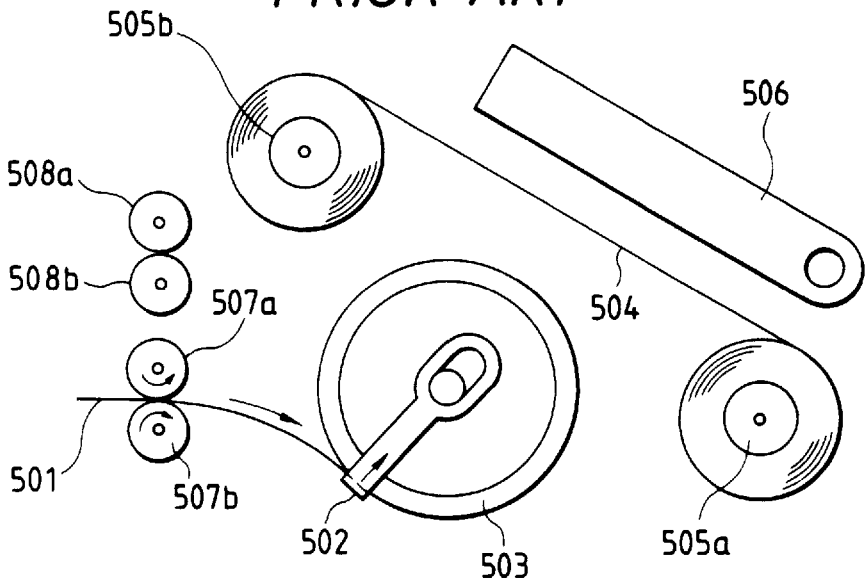
FIG. 24 PRIOR ART
FIG. 24 through FIG. 27 are charts for descriptions of the printing process common to the present invention and a sixth conventional system.
Figure 25:
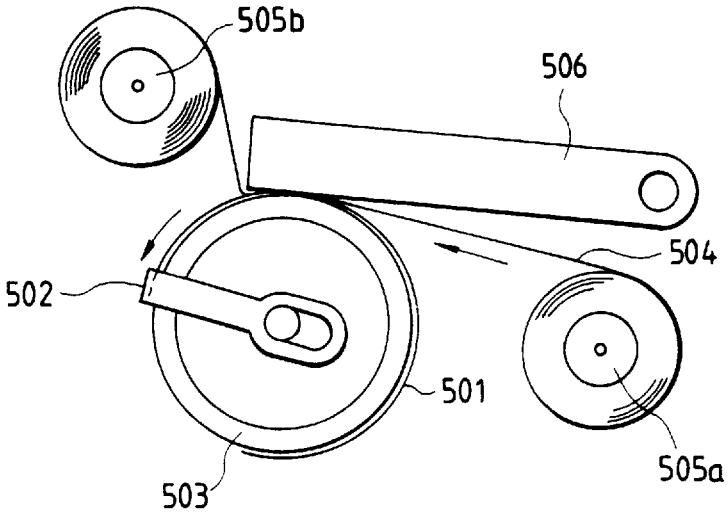
FIG. 25 PRIOR ART
Figure 63:
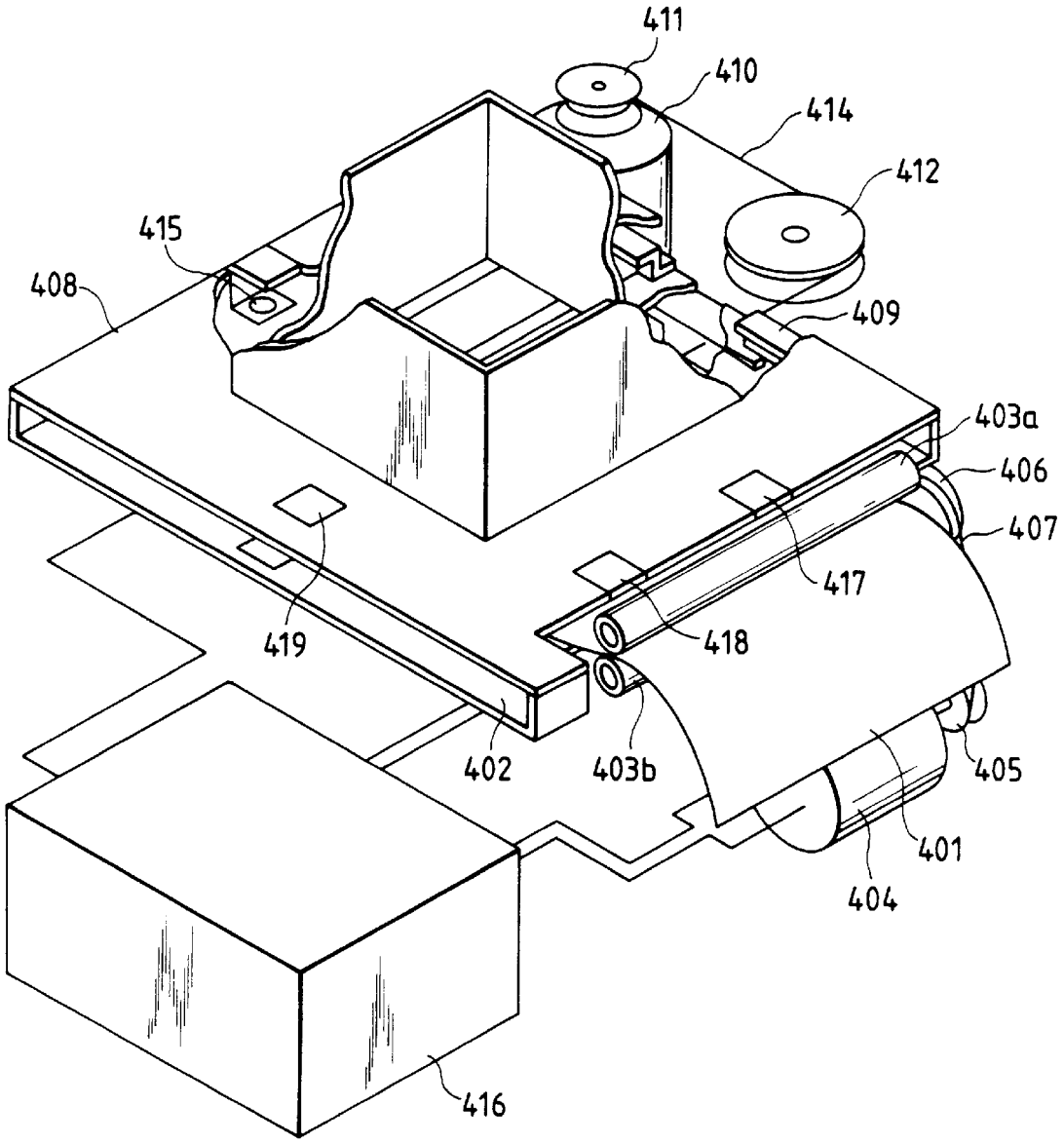
FIG. 63 is a perspective view with some part cut away in illustration of the printer according to the eighth preferred embodiment of the present invention.
Figure 64:
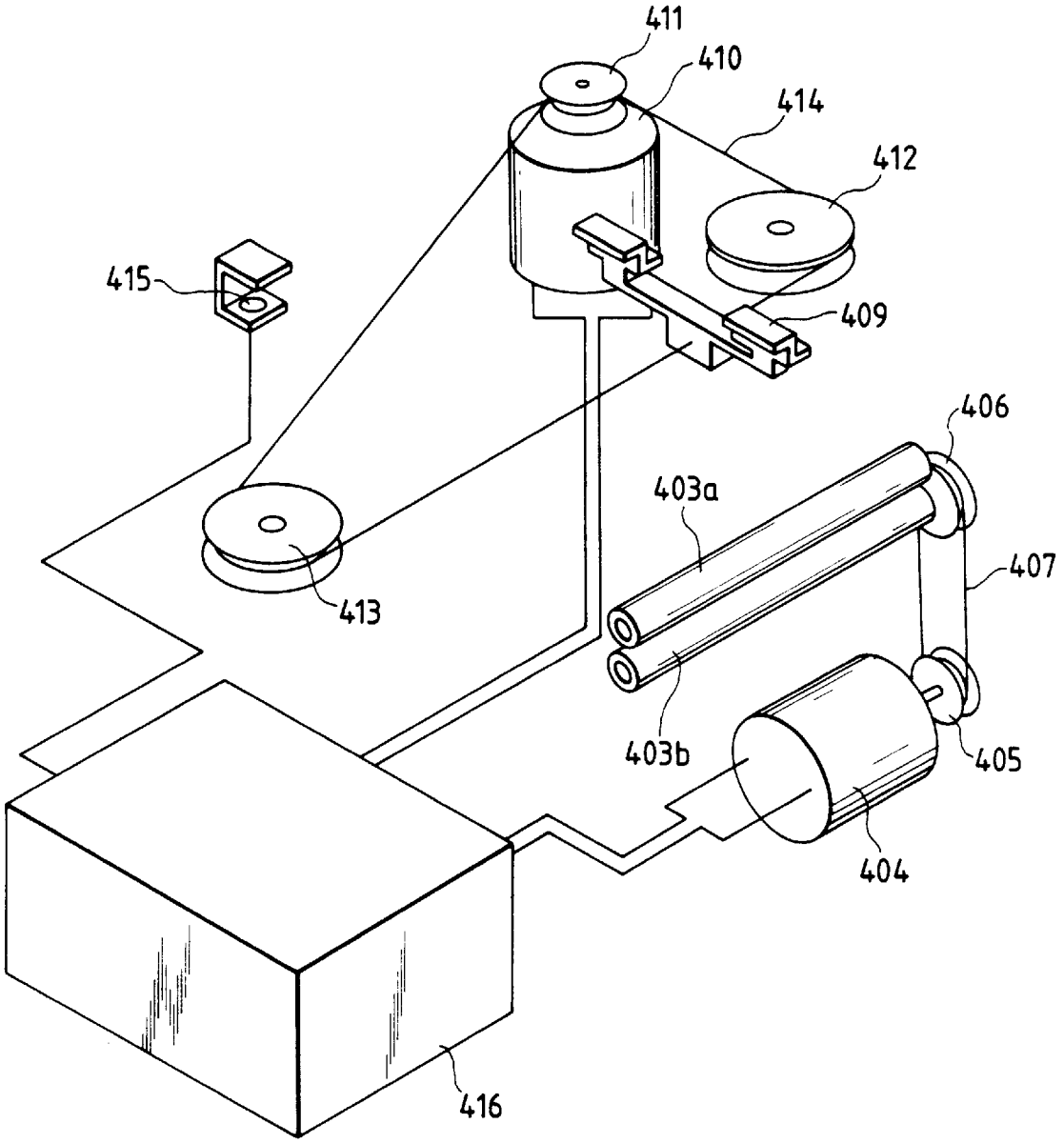
FIG. 64 is a perspective view illustrating only those members actually to be put into operation and the driving mechanism which performs control over those members in the example of the preferred embodiment illustrated in FIG. 63.
Figure 65:
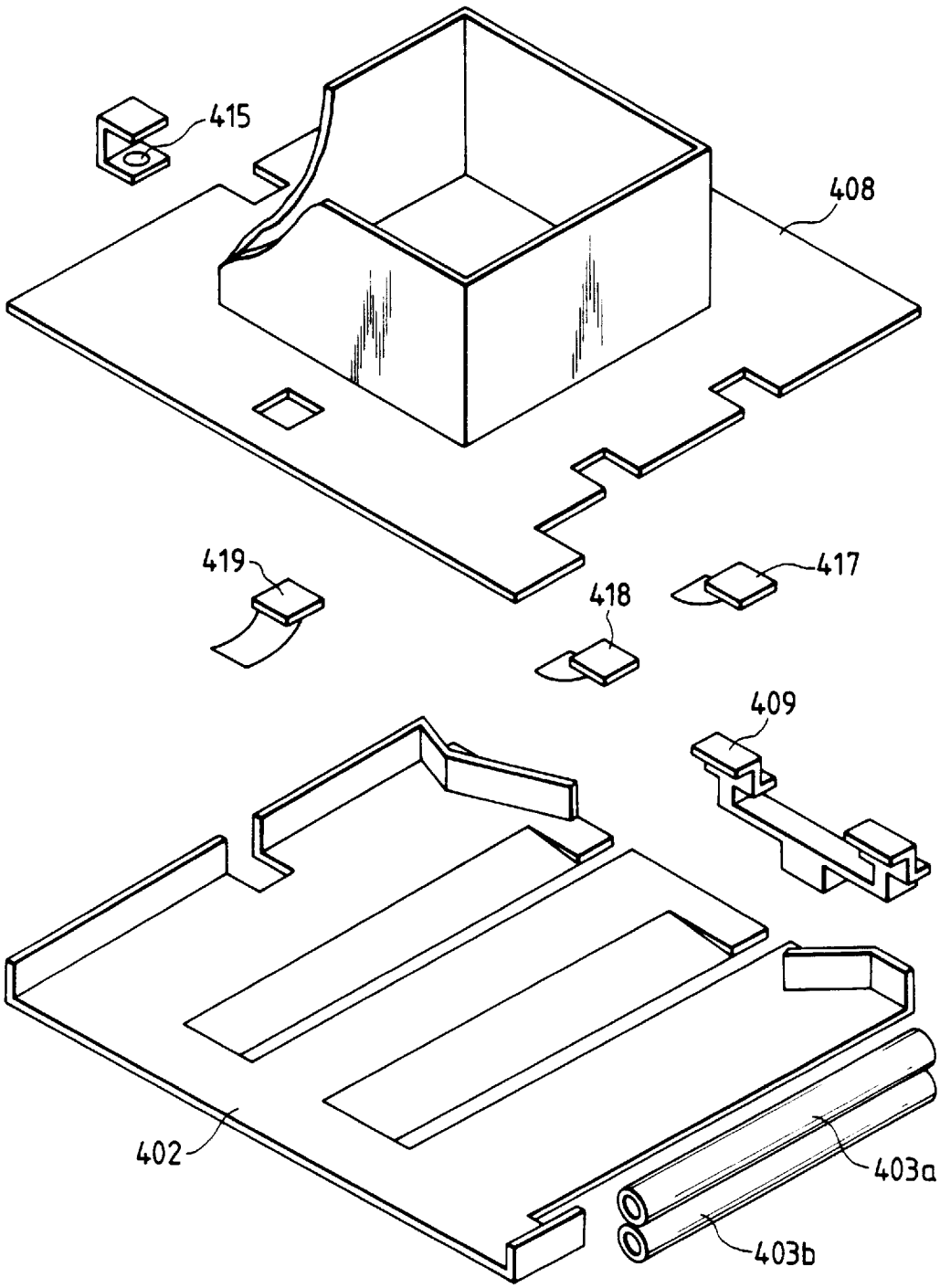
FIG. 65 is a perspective view with some part cut away showing the parts, excluding the driving mechanism shown in FIG. 63, as disassembled.

FIG. 63 is a perspective view with some part cut away in illustration of the printer according to the eighth preferred embodiment of the present invention, and FIG. 64 is a perspective view illustrating only those members actually put into operation and the construction of the driving mechanism which performs control over those members in the example of the preferred embodiment illustrated in FIG. 63. FIG. 65 is a perspective view with some part cut away showing the parts, excluding the driving mechanism shown in FIG. 63, as disassembled. In FIG. 63 through FIG. 65, the reference numbers 401 through 408 represent the parts which are either the same as or corresponding to the parts in the conventional printer described above and shown in FIG. 23. Hence, these parts are merely indicated by the same reference numbers, and their description is omitted here. The reference number 409 indicates the paper discharging block, which can be put into its sliding movement along the groove in the guide 402 mentioned above, and the reference number 410 denotes the motor, which forms the driving means for setting the above-mentioned paper discharging block 409 into its sliding movement. The reference number 411 indicates the pulley mounted axially on the shaft of the motor 410 mentioned above. The reference numbers 412 and 413 indicate the pulleys respectively supported in such a way as to permit their free rotation on a shaft not illustrated in the Figure. The reference number 414 shows the wire, both ends of which are fixed on the paper discharging block 409 mentioned above and formed into a loop by way of the pulley 411, the pulley 412 and pulley 413 mentioned above, and this wire serves as the transmitting means for the transmission of the driving power to the paper discharging block 409 mentioned above. The reference number 415 shows the photoelectric switch, the reference numbers 416 shows the control circuit, and the reference numbers 417, 418, and 419 indicate the paper holding members. The parts of these paper holding members which actually get into contact with the recording paper 401 are made of an elastic substance, and these paper holding members are capable of applying adequate pressure to the recording paper 401 mentioned above, thereby correcting the skew of the recording paper 401, when it passes through in contact with the above-mentioned paper holding members 417, 418, and 419 and the guide 402. Moreover, the paper holding members 417 and 418 mentioned above correct the skew of the recording paper 401 mentioned above at the time when the paper is transported by the above-mentioned transporting rollers 403*a* and 403*b*, and the paper holding member 419 corrects the skew of the above-mentioned recording paper 401 when the paper 401 is discharged by the above-mentioned paper discharging block.

Figure 66:
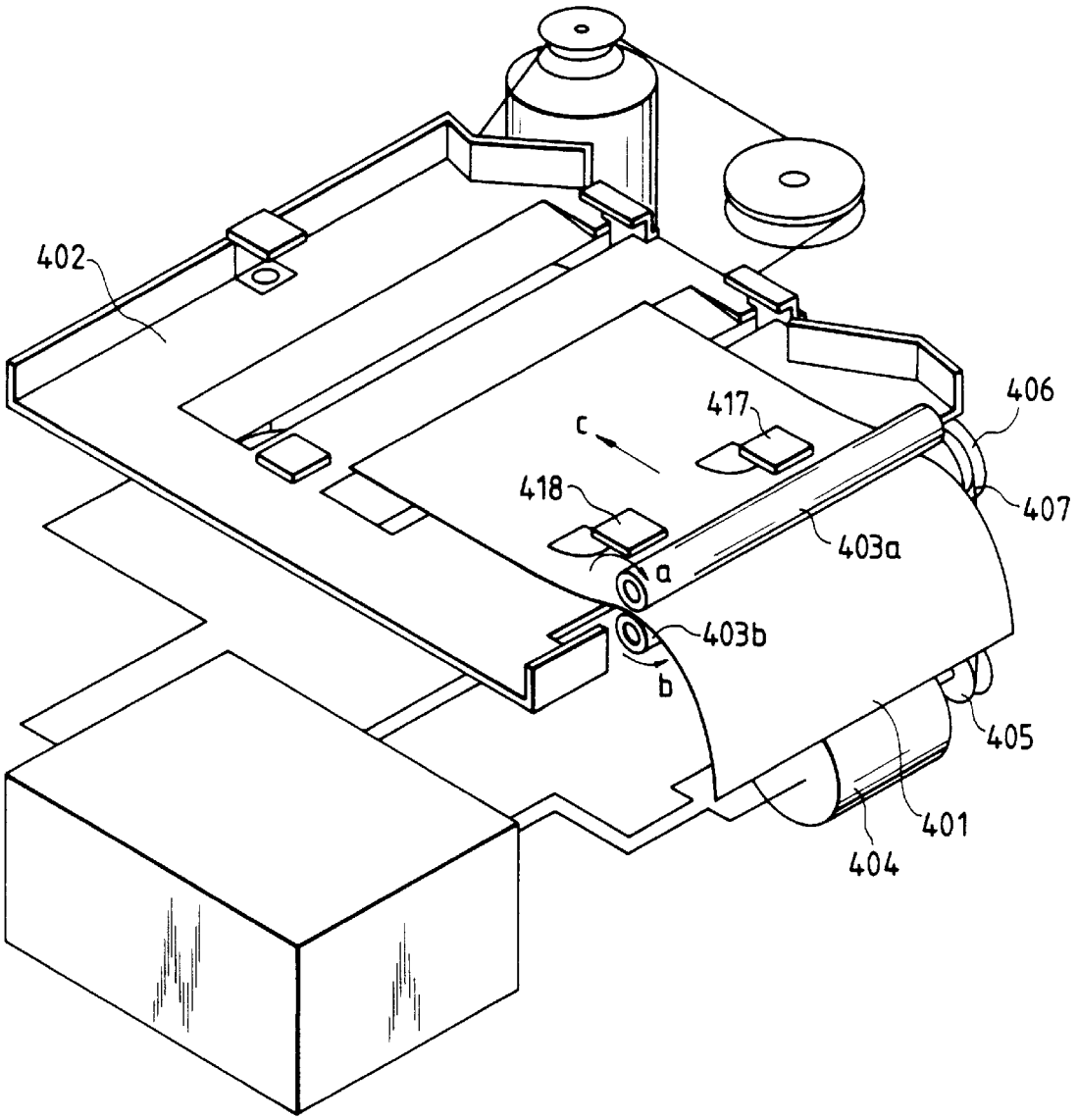
FIG. 66 is a perspective view illustrating the state of the transport of the recording paper by means of the transporting rollers in the operation of the mechanism shown in FIG. 63.
Figure 67:
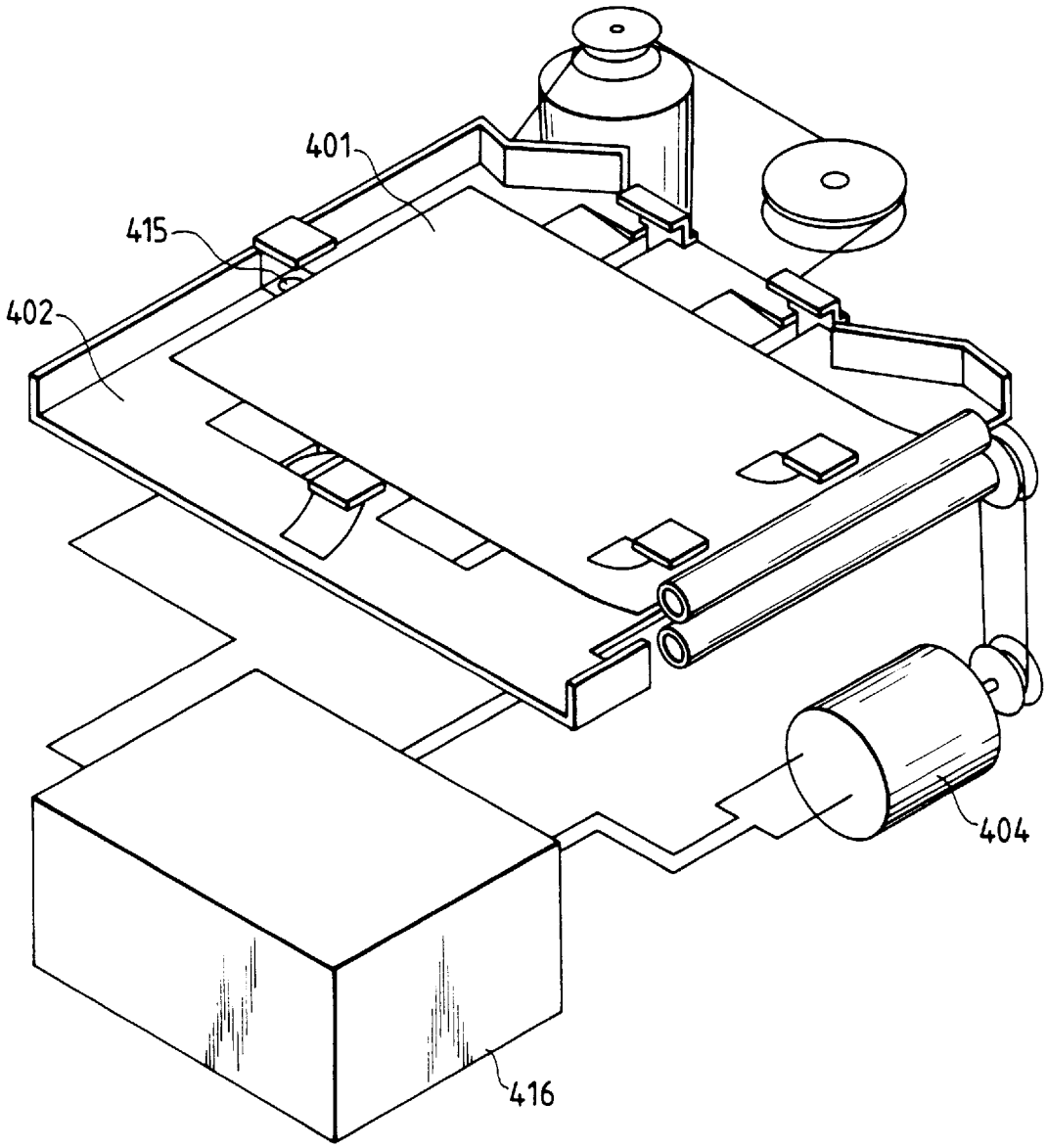
FIG. 67 is a perspective view illustrating the state of the completed transport of the recording paper with the transporting rollers in the operations shown in FIG. 63.
Figure 68:
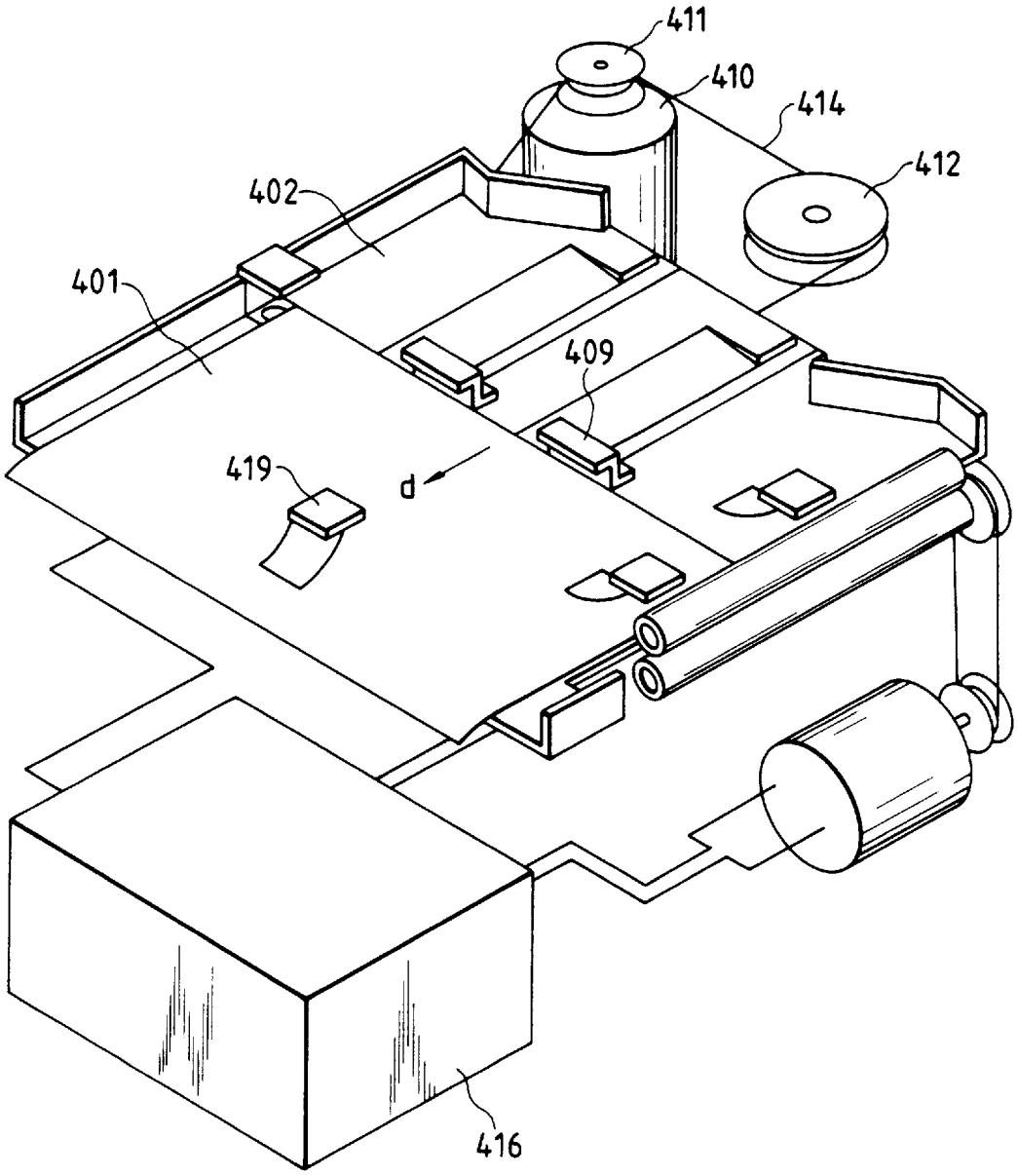
FIG. 68 a perspective view illustrating the state of the discharge of the recording paper with the paper discharging block in the operations shown in FIG. 63.

Now, the operations of the printer constructed in the manner described above are explained with reference to FIG. 66 through FIG. 68. However, the upper cover 408 is not illustrated in FIG. 66 through FIG. 68. First, in FIG. 66, the revolving power of the motor 404 is transmitted to the transporting roller 403*b* via the pulley 405, the wire 407, and the pulley 406, and, as the result of the transmission, the transporting rollers 403*a* and 403*b* are rotated respectively in the direction indicated by the arrow mark a and in the direction indicated by the arrow mark b. When the top edge of the recording paper 401 is fed into the slit between the transporting roller 403*a* and the transporting roller 403*b*, the recording paper 401 is transported in the direction indicated by the arrow mark c, having its skew corrected in this process of transport, and is then pushed out onto the guide 402. Then, as shown in FIG. 67, when the top edge of the recording paper 401 reaches the photoelectric switch 415 as the recording paper 401 is pushed out in its full length onto the guide 402, the control circuit 416 stops the revolution of the motor 404. Subsequently, as illustrated in FIG. 68, the control circuit 416 starts the motor 410 for its revolution, and the revolving power of the motor 410 is transmitted to the paper discharging block 409 through the pulley 411,412 and 413 not shown and the wire 414, and, as the result, the paper discharging block 409 proceeds in sliding motion in the direction indicated by the arrow mark d, pushing the sides of the recording paper 401 on the guide 402. On this occasion, the recording paper 401 is discharged while its skew is corrected by the paper holding member 419. When the discharge of the recording paper 401 is thus finished, the motor 410 revolves in reverse, under control by the control circuit 416, in order to push the block 409 into its sliding movement in the direction opposite to the direction for the discharge of the recording paper 401 (i.e. in the direction indicated by the arrow mark d), and the motor 410 stops when the paper discharging block 409 is thus evacuated into its normal position.

The paper handling mechanism according to the present invention is capable of performing the discharge of the recording paper with certainty through prevention of such troubles as the jamming of paper. The printer discharges the recording paper only after the recording paper is released completely from the transporting rollers, and performs all the operations while correcting the skew of the recording paper.

Figure 69:
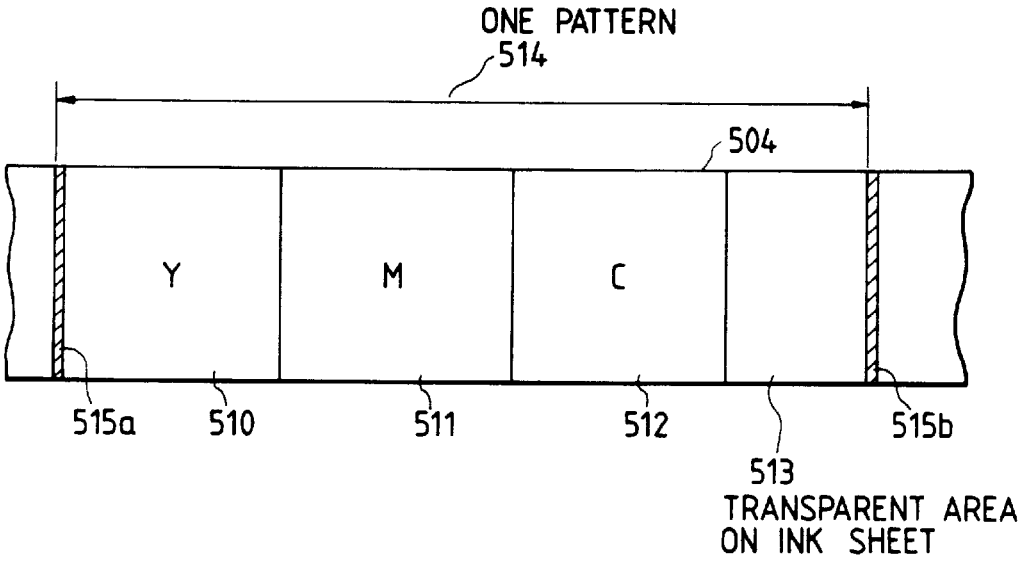
FIG. 69 is a development drawing of one pattern on the ink sheet for the color thermal printer in the ninth preferred embodiment of the present invention.

In the following part, the ninth example of the preferred embodiments of the present invention is explained with reference to the accompanying drawings. FIG. 69 is a chart showing the development of one pattern on the ink sheet for the color thermal printer in one example of embodiment of the present invention. In this Figure, the reference number 504 indicates the ink sheet, the reference number 510 shows the part of Y (yellow) in one pattern on the ink sheet 504. The reference numbers 511 and 512 respectively show the part of M (magenta) and the part of C (cyan). The reference number 513 expresses the transparent part. Moreover, the reference numbers 515*a* and 515*b* represent the marks for the detection with the sensor. As illustrated in the Figure, the development of the one pattern on the ink sheet 504 reveals the arrangement of Y (yellow) 510, M (magenta) 511, C (cyan) 512, and the transparent part 513 in the stated sequence.

As for the Figure illustrating the process for the transfer of images for printing in ink, a description is omitted here since the process relates to a construction identical to the prior art shown in FIGS. 24, 25, 26, and 27.

Figure 26:
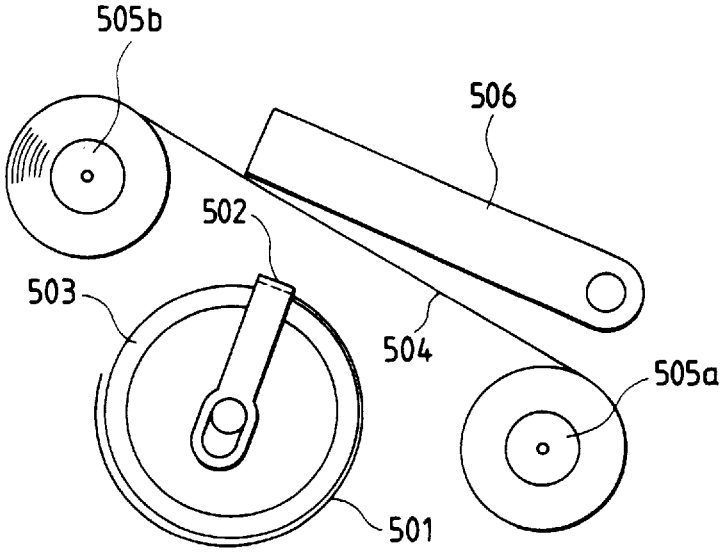
FIG. 26 PRIOR ART
Figure 27:
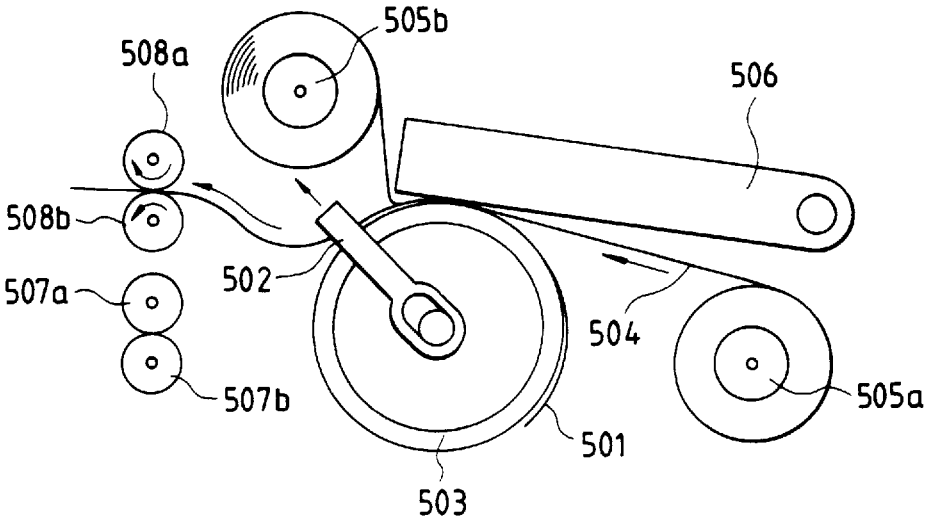
FIG. 27 PRIOR ART
Figure 28:
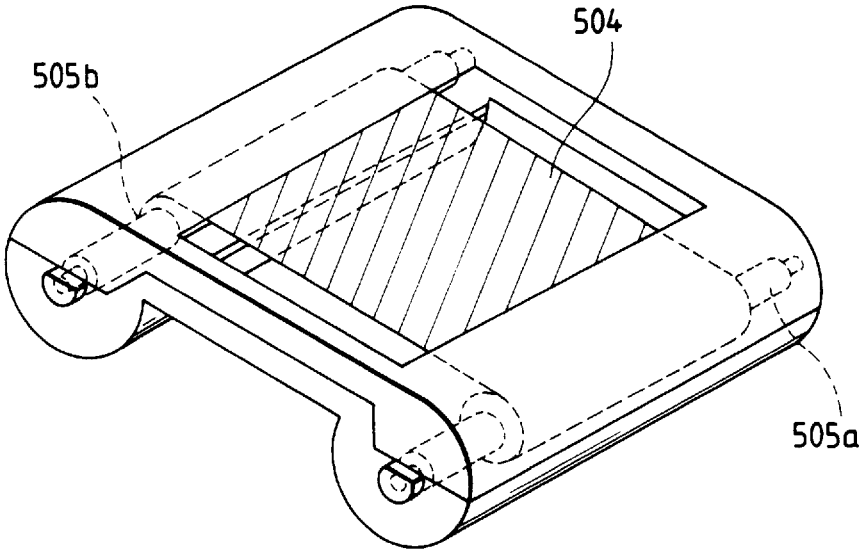
FIG. 28 PRIOR ART
FIG. 28 is a sketch drawing of the ink sheet cassette.
Figure 29:
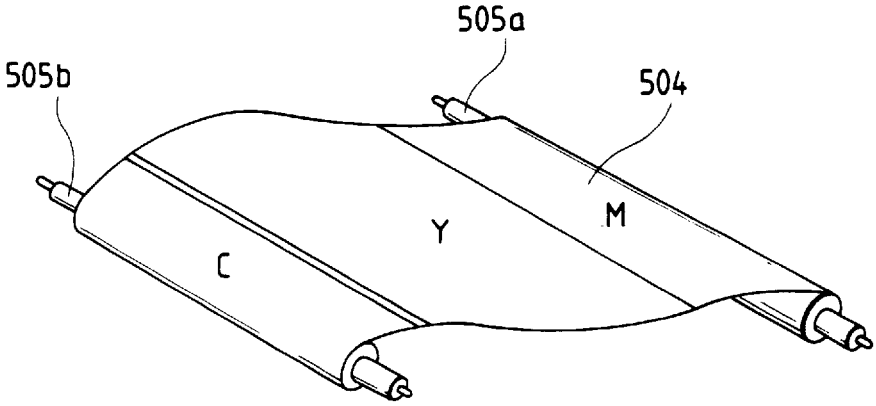
FIG. 29 PRIOR ART
FIG. 29 is a drawing illustrating the contents of the ink sheet cassette with the case removed.
Figure 30:
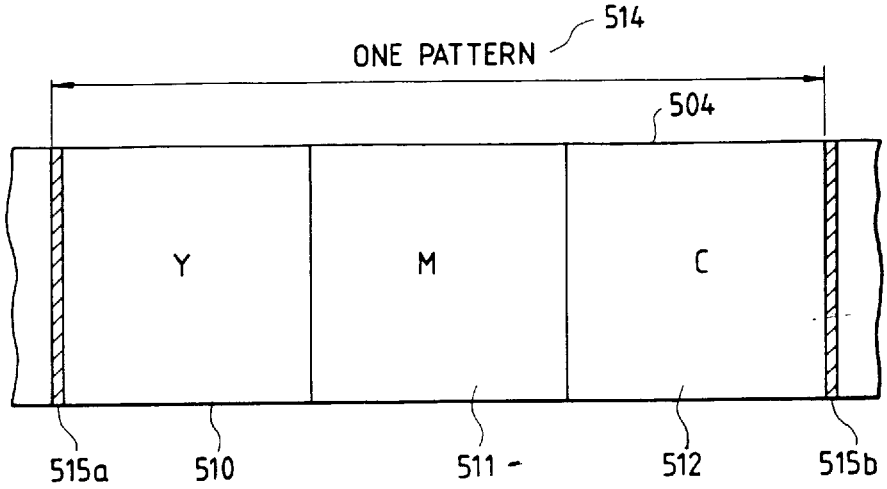
FIG. 30 PRIOR ART
FIG. 30 is a development drawing illustrating the pattern of the ink sheet 1 for the sixth conventional color thermal printer.

With the printer according to the present invention, the process for the transfer of images in Y (yellow), M (magenta), and C (cyan) is performed by the repetition of a cycle of exactly the same operations, as shown in FIG. 26 and FIG. 27. The thermal printing head 506 moves down to the recording paper 501 wound around the platen roller 503 and sets the ink sheet 504 into its close contact with the recording paper 501, and, as heat is applied to the heater line for the thermal printing head 506, each of the colors is transferred to the recording paper 501 in overlapping to a total of three applications. When the thermal printing head 506 moves down upon the completion of the passage of the clamper 502 following the completion of the transfer of images in C (cyan), which is the color to be applied finally, the clamper 502 is set into a state of its opening to the outside, and, the clamper 502 remaining in this state, the recording paper 501 is transported, together with the transparent part of the ink sheet 504, in the direction towards the paper discharging rollers 508*a* and 508*b*, and, when the recording paper 501 reaches the paper discharging rollers 508*a* and 508*b*, the paper is transported to the outside.

As a transparent part is provided as a pattern on the ink sheet, as just described, in the embodiment of the present invention in addition to the existing patterns on it, the recording paper is transported in the direction for its discharge by the use of the transparent part on the ink sheet forming a state other than that for the process of the transfer of images in ink, and, owing to this feature, the mechanism according to this invention is capable of producing prints with high-quality images without being liable to the occurrence of deviations of colors and other flaws, thus enhancing the quality of images as printed with a color thermal printer.

As described above, the present invention proposes an ink sheet on which a dummy sheet area, i.e. a transparent area with no ink coated thereon, is provided after the area coated with the printing ink in a pattern formed with Y (yellow), M (magenta), and C (cyan) as on the conventional ink sheet, and this novel feature makes it possible to transport the recording paper, using the transparent part of the ink sheet, in the direction for the discharge of the recording paper in a state other than that for the transfer of images in ink. This feature, therefore, can eliminate the factors for such flaws as deviation of color and can consequently achieve the effect of producing high-quality prints.

What is claimed is:

1. A printer for transferring an image onto recording paper that is transported from an input path to an output path comprising:

input means for conveying a sheet of recording paper along an input path;

a cylindrical platen roller rotatable about a longitudinal axis of rotation and comprising a circumferential outer surface, said roller being disposed so that said circumferential outer surface intersects said input path and said roller being sized to carry said paper sheet on said surface;

a clamping mechanism, movably attached to said roller and extendable between at least a first clamper position and a second clamper position, said clamping mechanism having a unitary structure comprising a clamper bar, said clamper bar being removed from pressing contact with said circumferential outer surface in said first clamper position and being paper-securably pressed against said circumferential surface in said second clamper position; and a control arm, moveable between at least a first position into contact with said unitary structure, whereby said clamping mechanism is moved to said first clamper position, and a second position, wherein said clamping mechanism is in said second clamper position, wherein said input means comprises means for controllingly operating said control arm in response to a mark on said sheet.

2. The printer as set forth in claim 1, further comprising means driving said control arm between said first and second positions, and wherein said input means further comprises means for detecting said mark on said paper and means for controlling said driving means in response to said detecting means.

3. The printer as set forth in claim 1, further comprising a paper cassette for storing paper sheets and wherein said input means comprises a photoelectric sensor for detecting said mark printed in a predetermined position on said recording paper, so that said clamper is operated on the basis of said mark.

4. The printer as set forth in claim 1, wherein said clamping mechanism is operative to clamp at least the leading edge of said paper sheet.

* * * * *